US011230841B2

(12) United States Patent
Marandos et al.

(10) Patent No.: US 11,230,841 B2
(45) Date of Patent: Jan. 25, 2022

(54) PLASTIC PANEL AND STRUCTURES USING THE SAME

(71) Applicant: Aus Group Alliance Pty Ltd, Keysborough (AU)

(72) Inventors: Nicholas Marandos, East Malvern (AU); Adam Lee Taylor, Seaford (AU); Graeme Peter Hall, Langwarren (AU); Graeme Francis Hisgrove, Brighton (AU); Neil Joseph Clowes, Pearcedale (AU); Adrian Leigh Massey, Narre Warren (AU)

(73) Assignee: Aus Group Alliance Pty Ltd, Keysborough (AU)

( * ) Notice: Subject to any disclaimer, the term of this patent is extended or adjusted under 35 U.S.C. 154(b) by 0 days.

(21) Appl. No.: 16/569,231

(22) Filed: Sep. 12, 2019

(65) Prior Publication Data

US 2020/0071931 A1 Mar. 5, 2020

Related U.S. Application Data

(63) Continuation of application No. 15/104,920, filed as application No. PCT/AU2014/050432 on Dec. 18, 2014, now Pat. No. 10,472,825.

(30) Foreign Application Priority Data

Dec. 20, 2013 (AU) ..... 2013273747

(51) Int. Cl.
*E04C 2/20* (2006.01)
*E04B 2/00* (2006.01)
(Continued)

(52) U.S. Cl.
CPC ..... *E04C 2/46* (2013.01); *E01F 8/0011* (2013.01); *E04C 2/20* (2013.01); *E04C 2/22* (2013.01);
(Continued)

(58) Field of Classification Search
CPC ... E04C 2/20; E04C 2/34; E04C 2/205; E04C 2/46; E04C 2003/0439
See application file for complete search history.

(56) References Cited

U.S. PATENT DOCUMENTS 2,999,568 A 9/1961 Ludwig et al.
3,037,593 A 6/1962 Webster
(Continued)

FOREIGN PATENT DOCUMENTS

CA 2 248 428 3/2000
EP 2446010 6/2012
(Continued)

OTHER PUBLICATIONS

International Search Report and Written Opinion for Application No. PCT/AU2014/050432, filed on Dec. 18, 2014, dated Mar. 11, 2015.
(Continued)

*Primary Examiner* — Brian E Glessner
*Assistant Examiner* — Daniel J Kenny
(74) *Attorney, Agent, or Firm* — Knobbe Martens Olson & Bear, LLP

(57) ABSTRACT

A hollow plastic wall panel, the panel having a length greater than a width, a thickness less than the width, a front wall, an opposite back wall and opposed first and second long edge regions, wherein the panel comprises a first end and a longitudinally opposite second end, wherein the first long edge region defines at least one first recessed portion to longitudinally receive and mate with a first longitudinal support structure and wherein the second long edge region defines at least one second recessed portion to longitudinally receive and mate with a second longitudinal support structure.

22 Claims, 15 Drawing Sheets

(51) Int. Cl.

| | |
|---|---|
| ***E04C 2/22*** | (2006.01) |
| ***E04H 17/16*** | (2006.01) |
| ***E01F 8/00*** | (2006.01) |
| ***E04C 2/34*** | (2006.01) |
| ***E04C 2/38*** | (2006.01) |

(52) U.S. Cl.
CPC ..... *E04C 2/34* (2013.01); *E04C 2/38* (2013.01); *E04H 17/16* (2013.01)

(56) References Cited

U.S. PATENT DOCUMENTS

| | | | | |
|---|---|---|---|---|
| 3,627,362 | A * | 12/1971 | Brenneman | F16B 5/0004 52/586.2 |
| 3,662,410 | A | 5/1972 | Lankheet | |
| 4,160,491 | A | 7/1979 | Matsumoto et al. | |
| 4,852,310 | A | 8/1989 | Henley et al. | |
| 4,984,406 | A | 1/1991 | Friesen | |
| 5,040,352 | A | 8/1991 | Oberlander et al. | |
| 5,150,993 | A | 9/1992 | Miller | |
| 5,217,771 | A | 6/1993 | Schmanski et al. | |
| 5,271,338 | A | 12/1993 | Bonham | |
| 5,272,284 | A | 12/1993 | Schmanski | |
| 5,372,886 | A | 12/1994 | Oberlander et al. | |
| 5,459,971 | A | 10/1995 | Sparkman | |
| 5,485,703 | A | 1/1996 | Nordahl | |
| 5,560,630 | A | 10/1996 | Phares et al. | |
| 5,564,586 | A * | 10/1996 | Goodwin | B65F 1/1646 220/844 |
| 5,702,090 | A | 12/1997 | Edgman | |
| 5,941,041 | A * | 8/1999 | Robinson | A63B 9/00 472/116 |
| 6,180,203 | B1 | 1/2001 | Unkles | |
| 6,412,597 | B1 | 7/2002 | Schola et al. | |
| 6,637,728 | B2 | 10/2003 | Pettit et al. | |
| 6,679,021 | B2 | 1/2004 | Maimon et al. | |
| 6,719,277 | B2 | 4/2004 | Ohanesian | |
| 6,745,537 | B1 | 6/2004 | Hamilton | |
| 6,899,200 | B1 | 5/2005 | Roberts | |
| 7,220,077 | B2 | 5/2007 | Humphries et al. | |
| 7,240,637 | B2 | 7/2007 | Rosen | |
| 7,478,797 | B2 | 1/2009 | Laws et al. | |
| 7,549,263 | B1 | 6/2009 | Porter | |
| 7,635,114 | B2 | 12/2009 | Laws | |
| 7,665,574 | B2 | 2/2010 | Schoela et al. | |
| 7,677,007 | B2 | 3/2010 | Parker | |
| 7,726,633 | B2 | 6/2010 | Cook et al. | |
| 7,739,846 | B2 | 6/2010 | Garrett | |
| 8,161,711 | B2 | 4/2012 | Steed et al. | |
| 8,176,697 | B1 | 5/2012 | Bolander, II | |
| 8,196,365 | B2 | 6/2012 | Parshad | |
| 8,511,648 | B2 | 8/2013 | McCarthy et al. | |
| 8,561,360 | B2 | 10/2013 | Corbin, Jr. | |
| 8,579,080 | B2 | 11/2013 | Angelico | |
| 8,651,232 | B2 | 2/2014 | Kedar et al. | |
| 9,091,069 | B2 | 7/2015 | Marandos et al. | |
| 9,499,978 | B2 * | 11/2016 | Glancy | E04C 2/292 |
| 9,714,110 | B2 * | 7/2017 | Veltrop | B67D 7/78 |
| 2001/0009703 | A1 | 7/2001 | Toshikawa | |
| 2002/0000545 | A1 * | 1/2002 | Pettit | E04H 17/1443 256/19 |
| 2003/0019170 | A1 | 1/2003 | Donnelly | |
| 2004/0045488 | A1 | 3/2004 | Danzik et al. | |
| 2004/0121100 | A1 | 6/2004 | Potempa | |
| 2005/0126852 | A1 | 6/2005 | Nakajima et al. | |
| 2007/0131480 | A1 | 6/2007 | Corbin et al. | |
| 2007/0158629 | A1 | 7/2007 | Laws et al. | |
| 2009/0056257 | A1 | 3/2009 | Mollinger et al. | |
| 2009/0193735 | A1 | 8/2009 | Kalinowski | |
| 2010/0154331 | A1 | 6/2010 | Dickens | |
| 2010/0243369 | A1 | 9/2010 | Fusiek et al. | |
| 2011/0167749 | A1 | 7/2011 | Azizi | |
| 2014/0097034 | A1 | 4/2014 | Marandos et al. | |
| 2016/0312467 | A1 | 10/2016 | Marandos et al. | |

FOREIGN PATENT DOCUMENTS

| | | |
|---|---|---|
| FR | 2 267 603 | 11/1975 |
| FR | 2 899 257 | 5/2007 |
| GB | 1 087 713 | 10/1967 |
| KR | 10-1331408 | 11/2013 |
| KR | 10-1399289 | 5/2014 |
| WO | WO 1997/038839 | 10/1997 |
| WO | WO 99/19574 | 4/1999 |
| WO | WO 2000/042255 | 7/2000 |
| WO | WO 2005/014947 | 2/2005 |
| WO | WO 2005/085544 | 9/2005 |
| WO | WO 2018/161122 | 9/2018 |
| WO | WO 2018/195605 | 11/2018 |

OTHER PUBLICATIONS

QueenslandRail, Systems and Capability Technical Requirement, "Design of Noise Barriers Adjacent to Railways", Sep. 30, 2010.
U.S. Appl. No. 15/104,920 U.S. Pat. No. 10,472,825, filed Jun. 15, 2016 Nov. 12, 2019, Plastic Panel and Structures Using the Same.
U.S. Appl. No. 16/569,231, filed Sep. 12, 2019, Plastic Panel and Structures Using the Same.

* cited by examiner 1947
1930
1909
1931
1902
1952
1906b
FIXING RIVET HERE
1906a
ROTATIONAL MOULDED SKIN
1904
DETAIL A
1912
1900
1902
1904
1907
1930
A
1911
1912
1909
1930
1902
1930
1904
1900
420, 421
ASSEMBLY 1930
1954
1934
1952
1932
1993b
1933
1952
1914b
1941
1993a
1992
1914a
1931
1962
1936
1962
1952
1939
1930

SECTION A-A

PLASTIC PANEL AND STRUCTURES USING THE SAME

CROSS-REFERENCE TO RELATED APPLICATIONS

This application is a continuation of U.S. patent application Ser. No. 15/104,920, filed on Jun. 15, 2016, which is a United States national stage application under 35 U.S.C. § 371 of PCT Application No. PCT/AU2014/050432 designating the United States, filed on Dec. 18, 2014, each of which is hereby incorporated by reference in its entirety, and PCT/AU2014/050432 claims priority to Australian Patent App. No. 2013273747, filed on Dec. 20, 2013.

TECHNICAL FIELD

The described embodiments relate generally to plastic panels and barriers or other structures using such panels and methods of their formation. In particular, embodiments relate to plastic panels suitable for use in sound attenuation barriers or other wall structures. The plastic panels may be generally hollow.

BACKGROUND

Sound attenuation barriers are used internationally to attenuate the transmission of noise from a noisy area, such as a roadway, industrial site or other high noise area. Such barriers are generally required to provide a certain specified degree of attenuation of noise passing from one side of the barrier to the other.

Sound attenuation barriers commonly include support structure anchored to the ground and a series of panels spanning the support structure to provide a continuous barrier along a desired distance. In some instances, such sound attenuation barriers must extend for a number of kilometres. Commonly, the panels used in existing sound attenuation barriers are formed of wood, concrete and/or steel. These panels are formed at a remote site, transported to the place where the barrier is to be erected, then affixed relative to the support structure to form the sound attenuation barrier. Steel panels are heavy and expensive and subject to graffiti. Wood panels are subject to burning, are more prone to deterioration and need significant maintenance. Concrete panels are quite heavy and can be prone to cracking or chipping. As it is commonly preferred to have sound attenuation barriers provide an aesthetically appealing appearance, cracking or chipping of the panels is undesirable and the panel manufacturer may be required to replace any such damaged panel at its own cost. Further, concrete panel forming processes provide only limited flexibility to confer an appealing aesthetic appearance on an external face of the panel.

Another problem encountered in relation to sound attenuation barriers is the potential for vandalism, such as spray painted graffiti. Removal of graffiti from concrete panels can be problematic and expensive. Similarly, where a sound attenuation barrier is adjacent an area that throws up air-born particulate, such as a roadway, airborne pollutants commonly accrete onto the panels over time and need to be cleaned in order maintain an aesthetically pleasing appearance. For some panel materials, it can be hard to clean the pollutants from the panel surfaces.

It is desired to address or ameliorate one or more shortcomings or disadvantages associated with prior techniques for sound attenuation barriers and panels, or to at least provide a useful alternative thereto.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

SUMMARY

Some embodiments relate to a hollow plastic wall panel, the panel having a length greater than a width, a thickness less than the width, a front wall, an opposite back wall and opposed first and second long edge regions, wherein the panel comprises a first end and a longitudinally opposite second end, wherein the first long edge region defines at least one first recessed portion to longitudinally receive and mate with a first longitudinal support structure and wherein the second long edge region defines at least one second recessed portion to longitudinally receive and mate with a second longitudinal support structure.

The front wall may be formed to have a substantially continuous convex curvature across a front face of the front wall from adjacent the first long edge region to adjacent the second long edge region. A maximum distance of the front wall from the first and second long edge regions in the thickness direction due to the convex curvature may be between about 10 mm and about 30 mm.

The length of the panel may be between about 2 in and about 4 m. The thickness of the panel may be between about 15 cm and about 25 cm. The width of the panel may be between about 30 cm and about 100 cm. The panel may have a substantially hollow shell structure defined at least in part by the front and back walls. The shell structure may be substantially free of joining portions that extend between the front and back walls other than at the first and second ends and the long edge regions. The shell structure may be formed of at least one polyolefin material suitable for rotational moulding.

The panel may further comprise a plurality of spacer elements interposed between the front wall and the back wall. One or more of the spacer elements may be formed of moulded plastic. Each spacer element may have opposed outer edges to respectively brace against an inner surface of the front wall and an inner surface of the back wall. At least one of the spacer elements may have coupling structure to couple with cooperating coupling structure of another panel. Each of the spacer elements may be coupled to inwardly extending flanges of the front wall and the back wall.

Each of the spacer elements may have a first recessed portion at one end and a second recessed portion at an opposite end. The at least one first recessed portion of the panel may be defined at least in part by first recessed portions of the spacer elements, and the at least one second recessed portion of the panel may be defined at least in part by second recessed portions of the spacer elements. The at least one first recessed portion and the at least one second recessed portion may be defined in part by a gap that separates the front and back walls from each other.

The front wall may have a substantially consistent thickness. The first and second recessed portions may have substantially the same shape. The first and second recessed portions of the panel may be generally longitudinally extending and approximately u-shaped in cross-section. The first and second recessed portions may be defined by the panel to have a depth and a width, wherein the depth is about half of the width.

A first distance in the thickness direction of the first and second recessed portions from the front wall may not be equal to a second distance in the thickness direction of the first and second recessed portions from the back wall. The panel may be free of non-moulded longitudinal reinforcing structure.

The panel may define at least one locating recess to allow positioning of the panel in one or more specific positions in relation to cooperating structure on the first or second support structure. The panel may be configured to accommodate movement due to thermal expansion or contraction in the length direction or the width direction relative to the first and second support structure.

Attenuation of sound through the panel may be at least about 25 decibels at frequencies between 250 Hz and 5000 Hz. At least the front and back walls may be formed by rotational moulding. The panel may be for use in erecting a sound attenuation barrier near a roadway.

Some embodiments relate to a barrier comprising:

at least one panel as described above;

vertically extending support structure that is fixed relative to the ground; and the first and second support structures coupled to the vertically extending support structure;

wherein the first and second support structures are respectively received in the at least one first recessed portion and the at least one second recessed portion so that the at least one panel is supported by the first and second support structure.

A first beam of the first and second support structures may be fixedly connected to the vertically extending support structure at a lowest beam position and at least a second beam of the first and second support structures may be clamped to the vertically extending support structure at a position vertically spaced above the lowest beam position to secure at least one panel between the first beam and the second beam. The panels may be positioned end-to end in a line between the first beam and the second beam:

Some embodiments relate to a method of erecting a barrier, comprising:

erecting vertically extending support structure that is fixed relative to the ground;

coupling at least two vertically spaced, horizontally extending support beams to the vertically extending support structure; and positioning at least one panel described above to be supported in between two of the at least two horizontally extending support beams.

The coupling may comprise fixedly connecting a first one of the horizontally extending support beams to the vertically extending support structure at a lowest beam position and clamping at least a second one of the horizontally extending support beams at a position vertically spaced above the lowest beam position to secure at least one panel between the first one beam and the second one beam.

The coupling and positioning may be performed in sequence so that a lower support beam is coupled to the vertically extending support structure, then at least one panel is positioned to rest on the lower support beam, then an upper support beam is coupled to the vertically extending support structure to hold the at least one panel in between the lower support beam and the upper support beam. The positioning may comprise positioning two of the panels end-to-end in a line between two of the horizontally extending support beams.

Some embodiments relate to a method of manufacturing a plastic wall panel, the method comprising:

forming a plastic front wall and a plastic back wall, the front wall and the back wall having a generally same length, width and thickness;

positioning a plurality of spacers between the front wall and the back wall and coupling each of the spacers to the front wall and the back wall to substantially fixedly position the front wall in relation to the back wall in a generally aligned, longitudinally parallel, spaced, opposing arrangement.

wherein the front wall, the back wall and the spacers are configured to define a panel having a length greater than a width, a thickness less than the width, a first end and a longitudinally opposite second end, the panel having opposed first and second long edge regions, wherein the first long edge region defines at least one first recessed portion to longitudinally receive and mate with a first longitudinal support structure and wherein the second long edge region defines at least one second recessed portion to longitudinally receive and mate with a second longitudinal support structure.

The front wall and back wall may be formed by rotational moulding. The front wall and back wall may be formed separately.

Some embodiments relate to a method of manufacturing a plastic wall panel, the method comprising:

rotationally moulding a plastic wall panel shell, the shell having a length greater than a width, a thickness less than the width, a front wall, an opposite back wall and opposed first and second long edge regions, wherein the panel comprises a first end and a longitudinally opposite second end, wherein the first long edge region defines at least one first recessed portion to longitudinally receive and mate with a first longitudinal support structure and wherein the second long edge region defines at least one second recessed portion to longitudinally receive and mate with a second longitudinal support structure.

The front wall may be formed to have a substantially continuous convex curvature across a front face of the front wall from adjacent the first long edge region to adjacent the second long edge region. A maximum distance of the front wall from the first and second long edge regions in the thickness direction due to the convex curvature may be between about 10 mm and about 30 ram.

The shell may be moulded to have at least one bridging portion bridging between the front and back walls, the at least one bridging portion being positioned longitudinally inwardly of the first and second ends. The shell may be moulded to define at least one recess in the back wall at the first end. The shell may be moulded to define third and fourth recesses partly coinciding with the first and second recessed portions, respectively, at the first end.

The panel may be formed to have at least one bridging portion bridging between the front and back walls, the at least one bridging portion being positioned longitudinally inwardly of the first and second walls The length of the panel may be between about 2 in and about 4 m. The thickness of the panel may be between about 15 cm and about 25 cm. The width of the panel may be between about 30 cm and about 100 cm. The panel may have a substantially hollow shell structure defined at least in part by the front and back walls.

Some embodiments relate to a cladding for a building, comprising support structure and a plurality of the wall panels described herein, wherein the wall panels are coupled to the support structure to form at least part of the cladding.

Some embodiments relate to a building exterior, comprising support structure and a plurality of the wall panels described herein, wherein the wall panels are coupled to the support structure to form at least part of the building exterior. Some embodiments relate to a building structure comprising a plurality of the panels described herein.

BRIEF DESCRIPTION OF DRAWINGS

Embodiments are described in further detail below, by way of example, with reference to the accompanying drawings, in which.

DETAILED DESCRIPTION

Figure 1A:
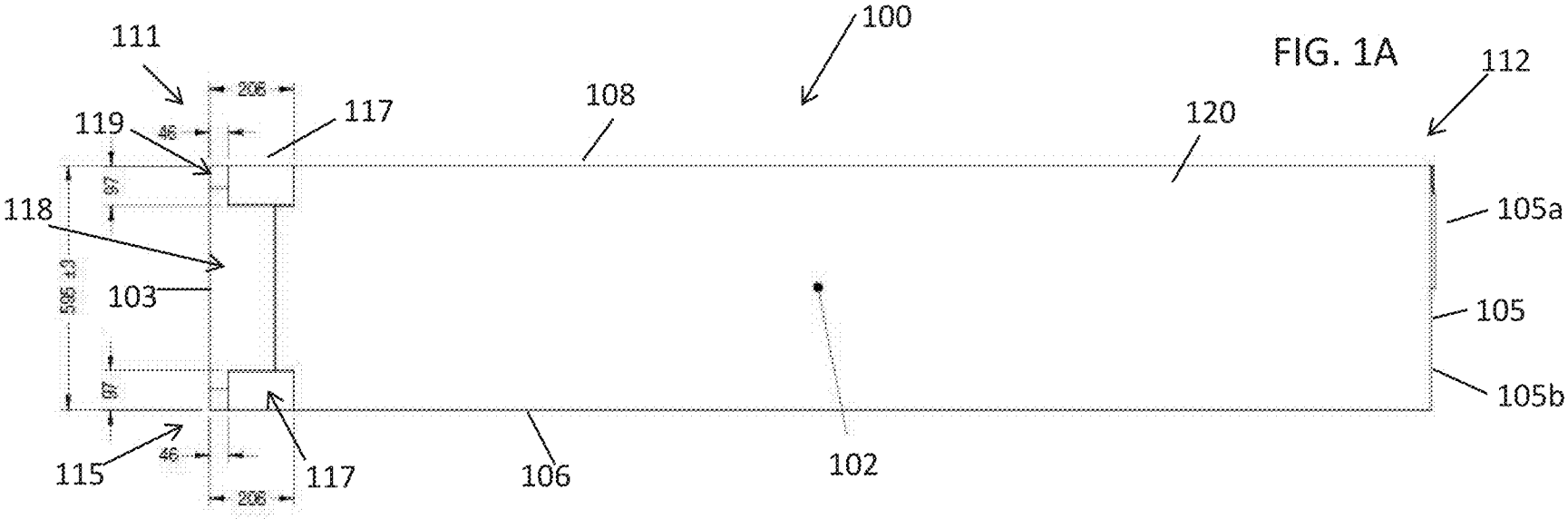
FIG. 1A is an elevation view of a back side of a panel according to some embodiments.

Described panels may be formed by rotational moulding techniques using existing rotational moulding technology. Such techniques may involve formation of a mould, addition of plastic granules into the mould, closure of the mould and then simultaneous rotation and heating of the plastic inside the closed mould in order to melt the plastic evenly around the heated surfaces of the mould. Use of rotational moulding techniques in the context of forming embodiments of plastic panels is described herein in more detail in relation to FIG. 22 below.

Described panels can be used to form walls or barriers or to form part of a building structure, for example. In some embodiments, described panels can be used together with support structures to form sound attenuation barriers that can extend for hundreds of metres and possibly kilometres. When used for such sound attenuation barriers, described panels provide for a lighter, less expensive and more easily transportable form of panel than the concrete panels of the prior art.

Referring now to FIGS. 1A, 1B, 1C, 2 and 3, a panel 100 according to some embodiments will now be described in further detail. Panel 100 comprises a front side wall 104, a back side wall 102, a first end face 103 at a first end 111, a second end face 105 (approximately parallel to the first end face 103) at a second end 112, a bottom edge face 106 and a substantially parallel top edge face 108. The bottom edge face 106 is contoured to define a longitudinally extending recess 107 and the top edge face 108 is contoured to provide a similarly shaped longitudinally extending recess 109. Using corresponding recesses 107 and 109, multiple panels 100 can be held in place by support structure, such as support beams 420, 421, 422 (FIG. 4A), received in the recesses 107, 109. In this way, the panels 100 can be stacked one on top of another, with the beams 420, 421, 422 and recesses 107, 109 of the panels 100 providing mating structure for forming a stable wall or wall portion 500 comprising multiple panels 100. The thickness of the walls of panel 100 may be relatively uniform and may be nominally about 8 millimetres, although some small variation may occur across the different parts of the panel walls. Other panel embodiments may use a different nominal wall thickness, such as 6 to 10 millimetres, for example.

The front face of the front side wall 104 may be formed to have a textured external surface, as shown and described in relation to co-pending and co-owned International Patent Application No. PCT/AU2013/001177, the entire contents of which is hereby incorporated by reference. The textured external surface may have a stone (matte) appearance and may comprise a visually discernible pattern, such as geometric shapes or one or more symbols or parts of symbols. The one or more symbols may define one or more words or may convey a specific meaning, for example. Similarly, the back face of the back side wall 102 may be formed to have a textured external surface. The back surface may have a stone (matte) appearance and may comprise a visually discernible pattern, such as one or more symbols or parts of symbols. Such symbols or parts of symbols may define one or more words or convey specific meanings. Formation of panel 100 by rotational moulding allows the creation of varied visually aesthetically appealing or meaningful indicia or patterns to be provided on external exposed front and back faces of front and back walls 104, 102 of the panel 100, which may provide added appeal in some circumstances. Additionally, such surface variations can assist in strengthening the panel walls and/or hiding or at least visually obscuring some expansion or contraction in the plastic wall panels due to environmental temperature variation.

Each panel 100 has a length greater than its height and a height greater than its width when the panel 100 is oriented vertically in a normal vertical wall panel orientation as shown in FIGS. 1A and 1C and 5A to 5D. The length of each panel 100 may be about or just under three metres (e.g. 295 to 290 cm), while the height may be about one metre. In some embodiments, the height of the panel 100 may be up to about two metres or possibly up to about three metres. The depth of the recesses 107, 109 relative to the remainder of the bottom and top edge faces 106, 108 may be around 40 to 50 millimetres, for example. The maximum width of the panel 100 may be around 150 to 250 millimetres or possibly around 180 to 230 millimetres, for example. Specific embodiments may have a width (measured at the top and bottom edge faces 106, 108) of about 190 millimetres or about 200 millimetres.

The example dimensions given here may be varied, depending upon requirements, and are intended to only be generally indicative of the dimensions of some embodiments. Other embodiments can have different dimensions. For example, the panel length may be shorter, in the order of 2, 2.5 or 2.75 metres or other lengths in between about 2 and 3 metres. The panel length may alternatively be longer than 3 metres, for example up to 3.5, 4, 4.5 or 5 metres or up to about 6 metres. Panels of such longer lengths will generally require suitable reinforcing structure, such as the support beams and/or other support framework described herein, in order to tolerate high wind loads.

In the context of this application, given that the plastic panels described herein are subject to thermal expansion and contraction and may also experience some degree of flexion, the term "about" applied to a dimension of a part or a structural component of a panel should be understood to include dimensions in a range, such as an absolute range or a percentage range like 1%, 2%, 3%, 4% or 5%, either side the specified dimension. For example, a length of "about three metres" may be understood to include lengths in the range of 50-100 mm more or less than three metres, which equates to a particular percentage range of variation.

In some embodiments, the panel 100 may be formed during the moulding process to define shallow grooves or notches adjacent to or along each of the end faces 103, 105. These grooves or notches are for receiving a sealing gasket (not shown), which may be a compressible elastomeric plastic, rubber or silicone strip, for example. The sealing gasket may be attached to the end faces 103, 105 in the notches by suitable attachment means, such as screws or adhesives, for example. In some embodiments, such sealing gaskets may be affixed to end parts or faces of the panel 100 without any grooves or notches being formed on or in the panel 100. The sealing gasket is to minimize any noise transmission that otherwise might occur through a small gap between the edge of the panel 100 and the support structure to which the panel 100 is coupled or between adjacent panels positioned end-to-end.

The bottom and top long edge faces 106 and 108 have flat outer edge portions 106*a*, 106*b* and 108*a*, 108*b* on either side of the recessed portions 107, 109, respectively. The flat outer edge portions 106*a*, 106*b* and 108*a*, 108*b* may extend a first distance in the thickness direction of the first and second recessed portions from the front wall that is not equal to a second distance in the thickness direction of the first and second recessed portions from the back wall. In other words, the flat outer edge portion 106*b* that is adjacent the back wall 102 may be shorter or longer in the thickness direction than the length of the flat outer edge portion 106*a* adjacent the front wall 104 in the thickness direction.

Figure 3:
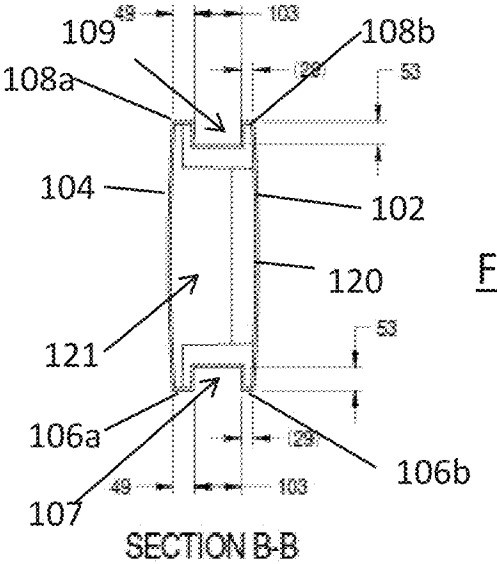
FIG. 3 is an end cross-sectional view of the panel of FIG. 1A, taken along line B-B of FIG. 1C and showing some internal detail of the panel.

As is shown best in FIG. 3, the recesses 107 and 109 are formed as slightly trapezoidal inward recessed portions that are recessed from the upper edge faces 108 and 106, with the side walls of the recesses 107, 109 being slightly angled, for example at about 3°, relative to the vertical, and tapering inwardly away from the external lower and upper edge faces 106*a*, 106*b* and 108*a*, 108*b*. Although not shown, a sealing gasket may be positioned as an elongate strip extending across the full length of the recess 107 or 109 in between an adjacent face of the elongate bar 420, 421, 422 and the corresponding inwardly recessed face of the recess 107, 109 of panel 100. This sealing gasket may serve to reduce any noise transmission that might occur through any small gap between the upper edge face 108 of one panel 100 and the lower edge face 106 of another panel 100 disposed on top of it.

Figure 1B:
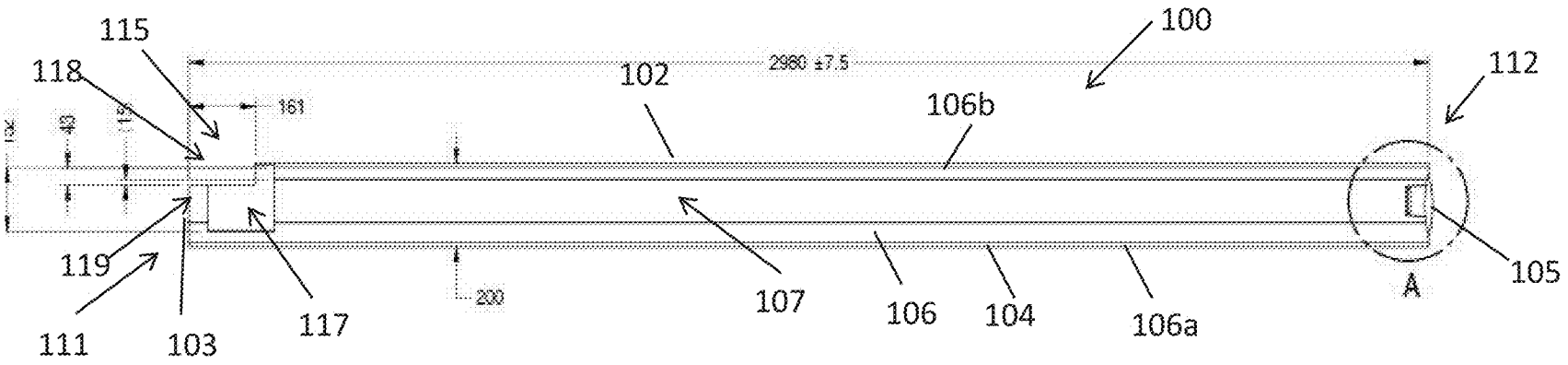
FIG. 1B is a plan view of the panel of FIG. 1A.
Figure 1C:
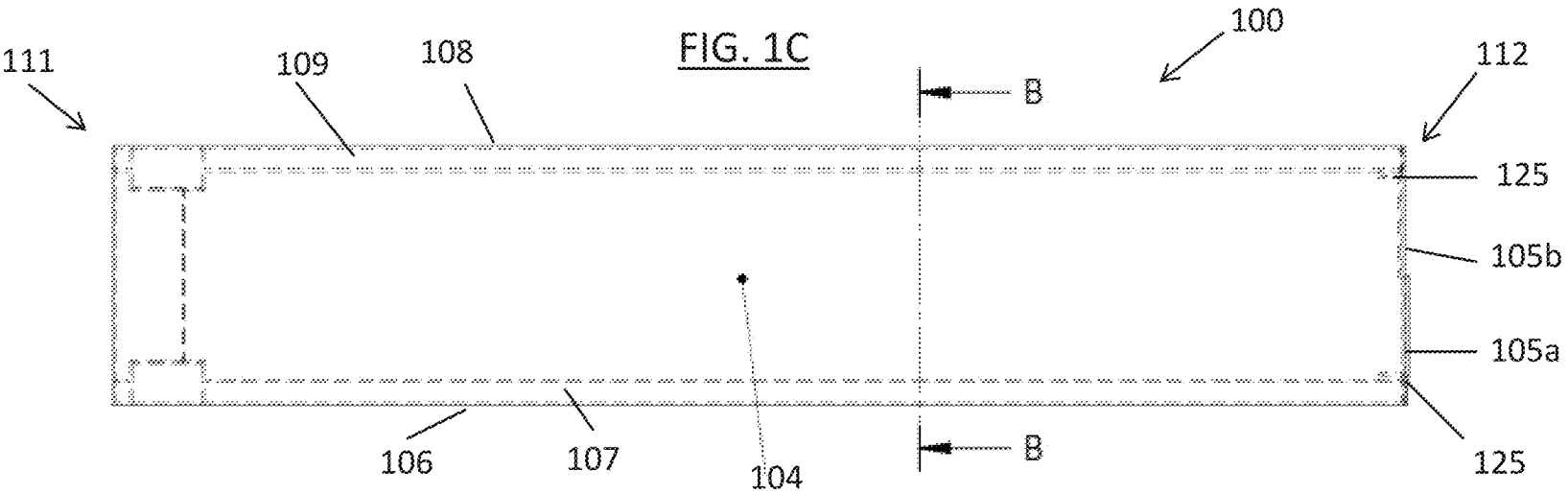
FIG. 1C is a front view of the panel of FIG. 1A.
Figure 10:
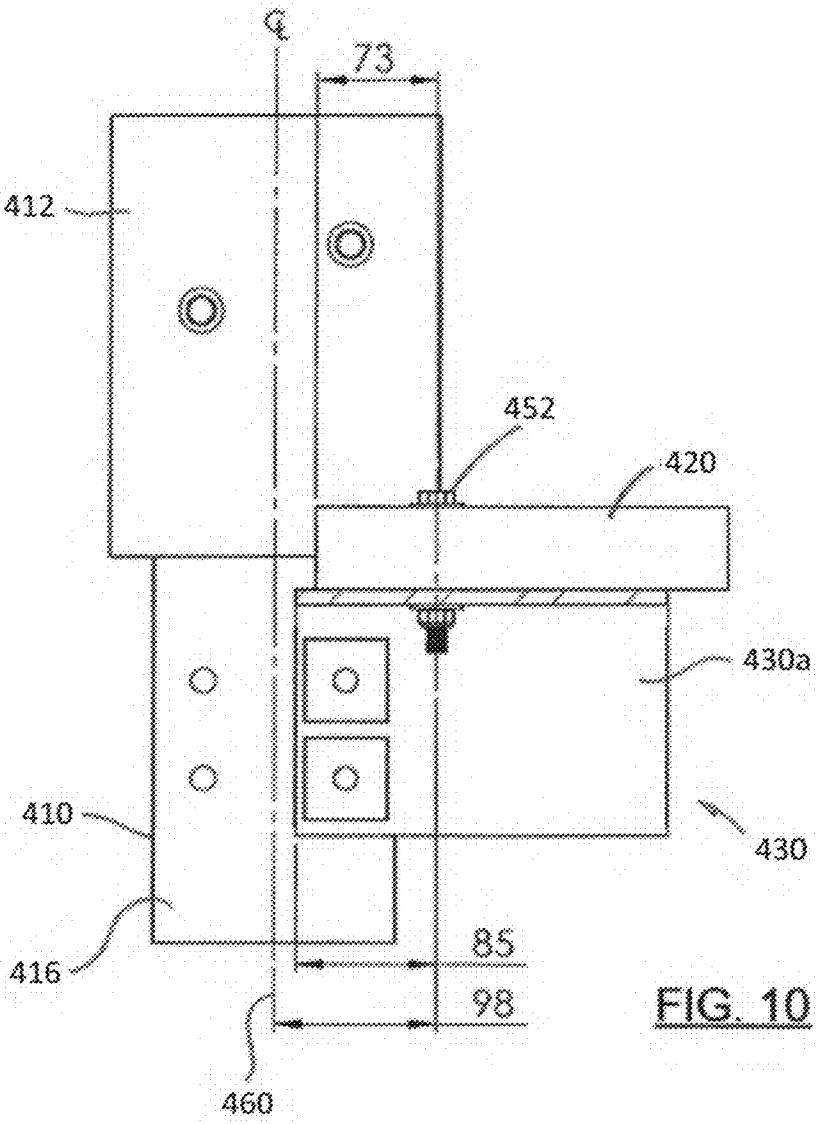
FIG. 10 is a sectional view of the lower part of the support frame shown in FIG. 9, taken along line H-H of FIG. 9.
Figure 9:
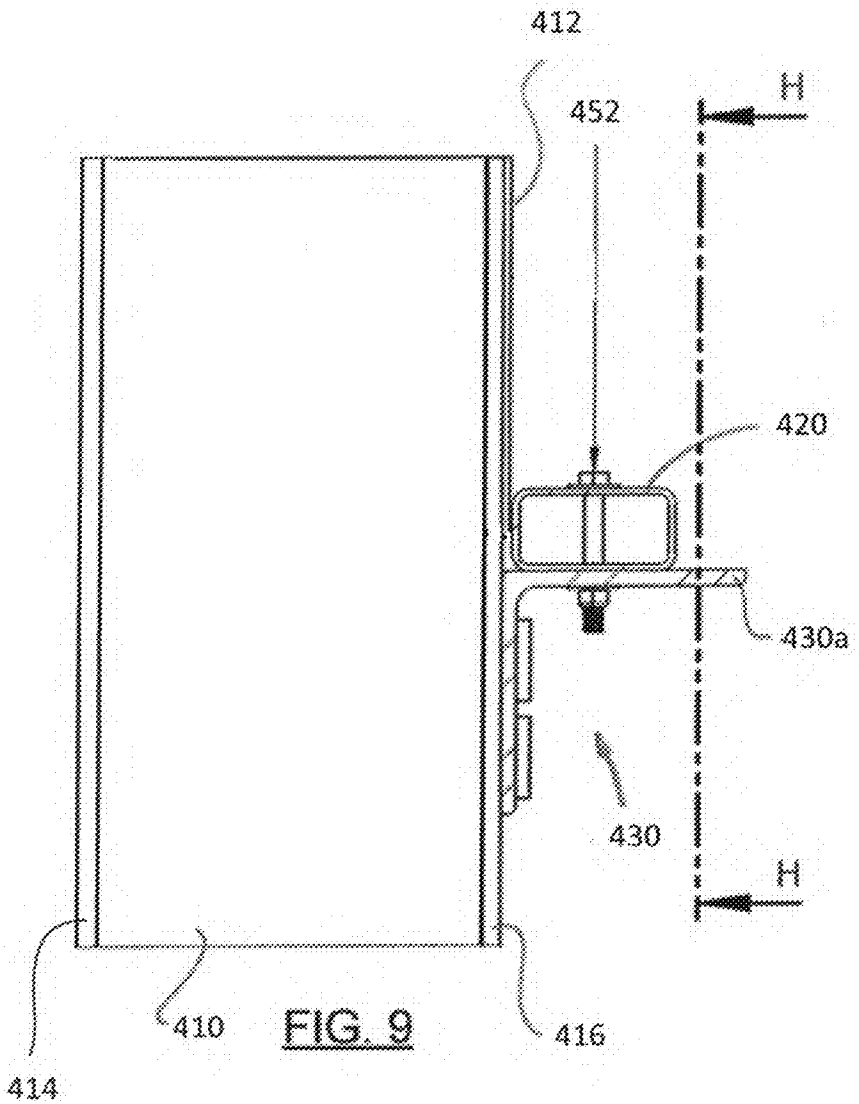
FIG. 9 is a close-up side view of a lower part of the support frame of FIG. 4A.
Figure 12:
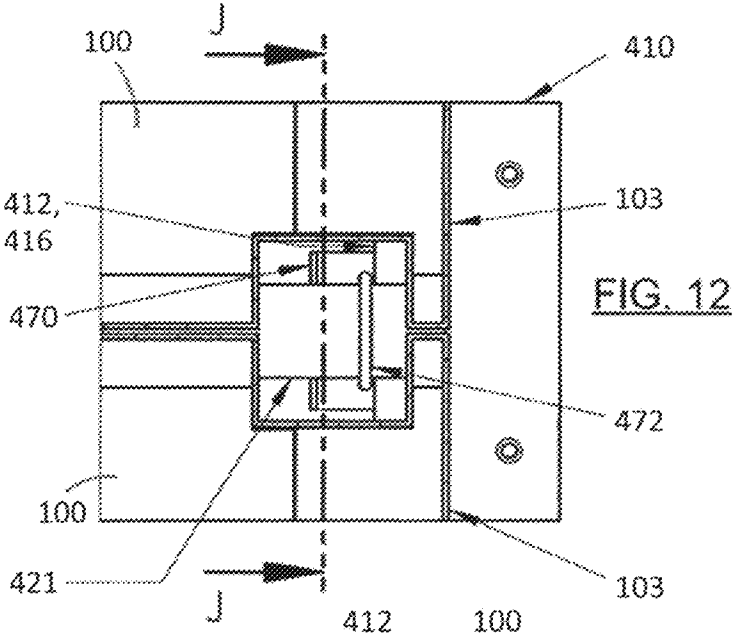
FIG. 12 is a cross-sectional view of the support beam clamping arrangement of FIG. 11, taken along line I-I of FIG. 5B.
Figure 14:
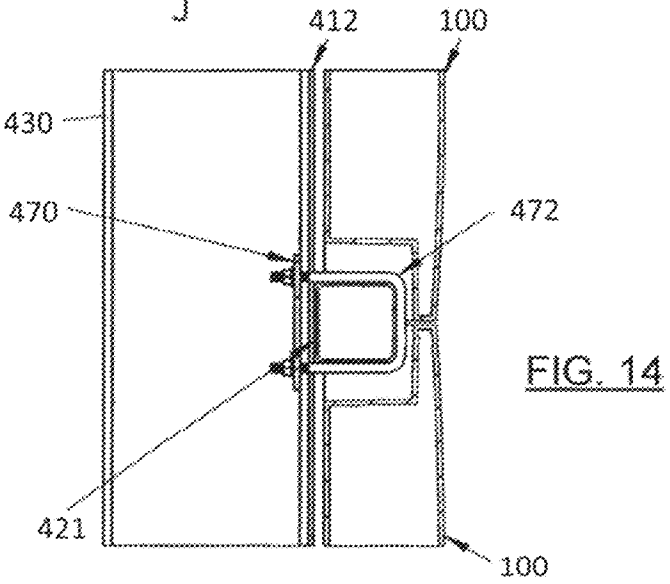
FIG. 14 is a cross-sectional view of the support beam clamping arrangement, taken along line J-J of FIG. 12.
Figure 11:
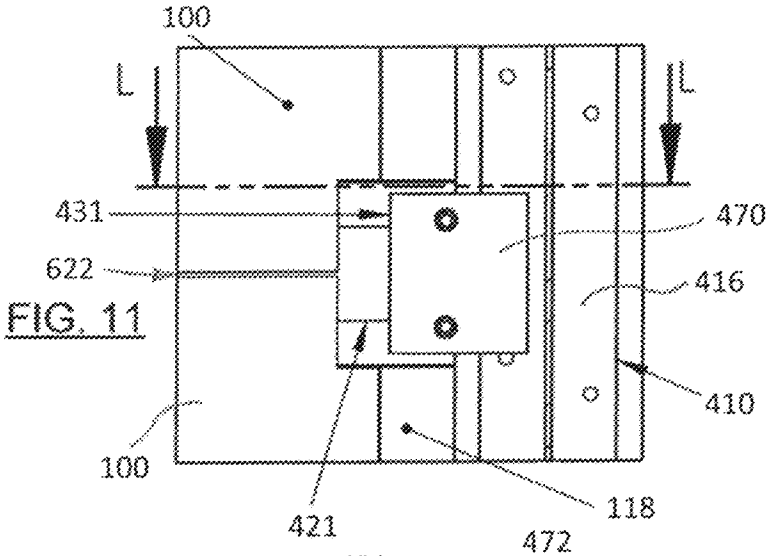
FIG. 11 is a cross-sectional view of a support beam clamping arrangement, taken along line K-K of FIG. 5B.
Figure 13:
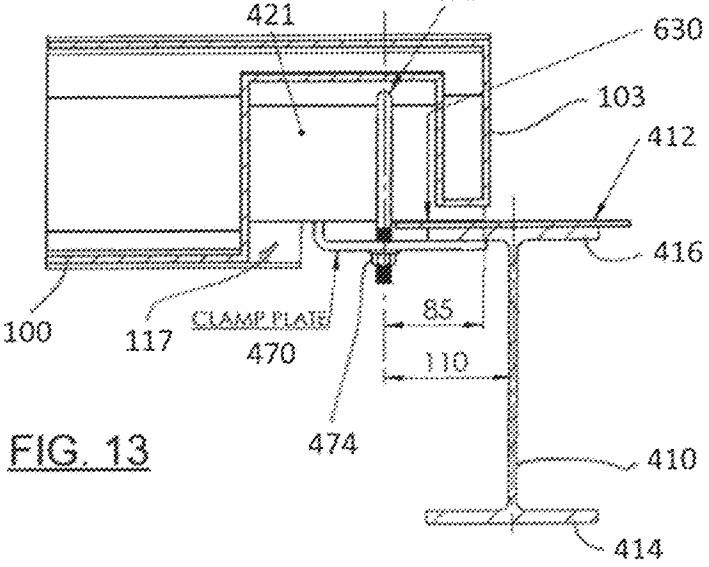
FIG. 13 is a cross-sectional view of the support beam clamping arrangement, taken along line L-L of FIG. 11.

As is shown best in FIGS. 1A and 1B, first end 111 of panel 100 has a series of recessed portions 117, 118 and 119 to accommodate coupling structure that is to be disposed about or adjacent to support beams 420, 421, 422 to couple them to vertical support beams, such as beams 410. The recessed portions include first opposed recessed portions 117 formed in the back wall 102 at or adjacent the respective top and bottom edges of the first end 111 to make space for the U-bolt 472 (FIGS. 13 and 14) or bolt 452 (FIGS. 9 and 10). A second recessed portion 118 extends inwardly from end face 103 to at least partially coincide with first recessed portions 117 and is shaped to curtail the extent of back wall 102 near first end 111 (and thereby reduce the width of the panel 100 at the first end) to allow a flange 416 of the vertical support beam 410 to be received in the recessed portion 118. The third recessed portion 119 generally coincides with the longitudinally extending recesses 107, 109 and is formed as an extension thereof to avoid any part of the first end 111 of the panel 100 interfering with the sliding movement of the panel 100 relative to any support beams 420, 421, 422.

Upper and lower front edge faces 106*a*, 108*a* are longer than the upper and lower hack edge faces 106*b*, 408*b* because the upper and lower hack edge faces 106*b*, 108*b* are truncated or cut short by the recessed portions 117 at the first end 111. The upper and lower front edge faces 106*a*, 108*a* extend the full length of the panel 100.

Figure 24:
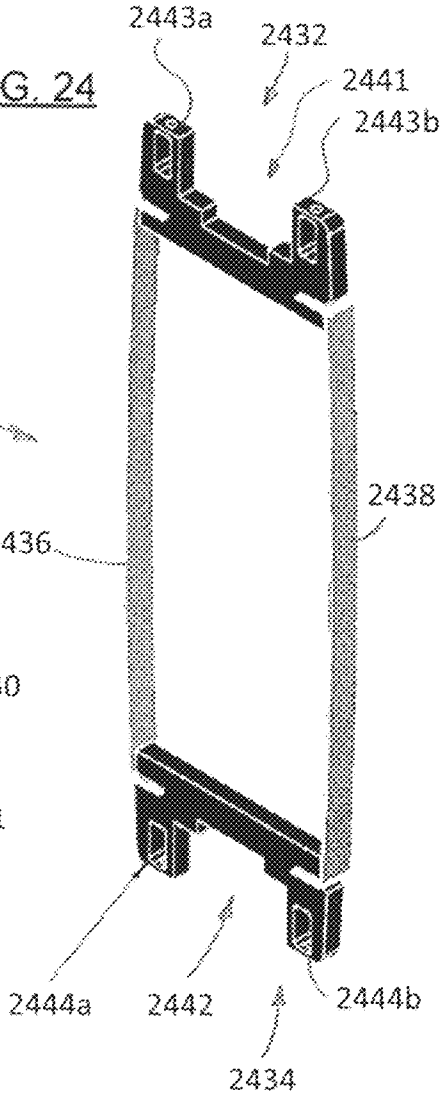
FIG. 24 is a perspective view of an alternative spacer according to some embodiments.
Figure 25C:
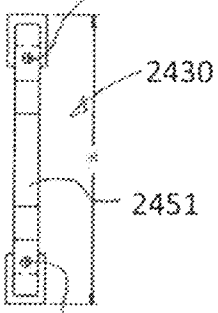
FIG. 25C is an end view of the spacer of FIG. 24.
Figure 25A:
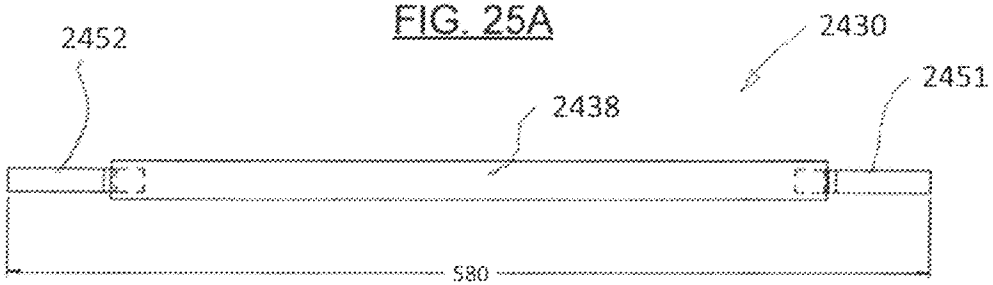
FIG. 25A is a side view of the spacer of FIG. 24.
Figure 25B:
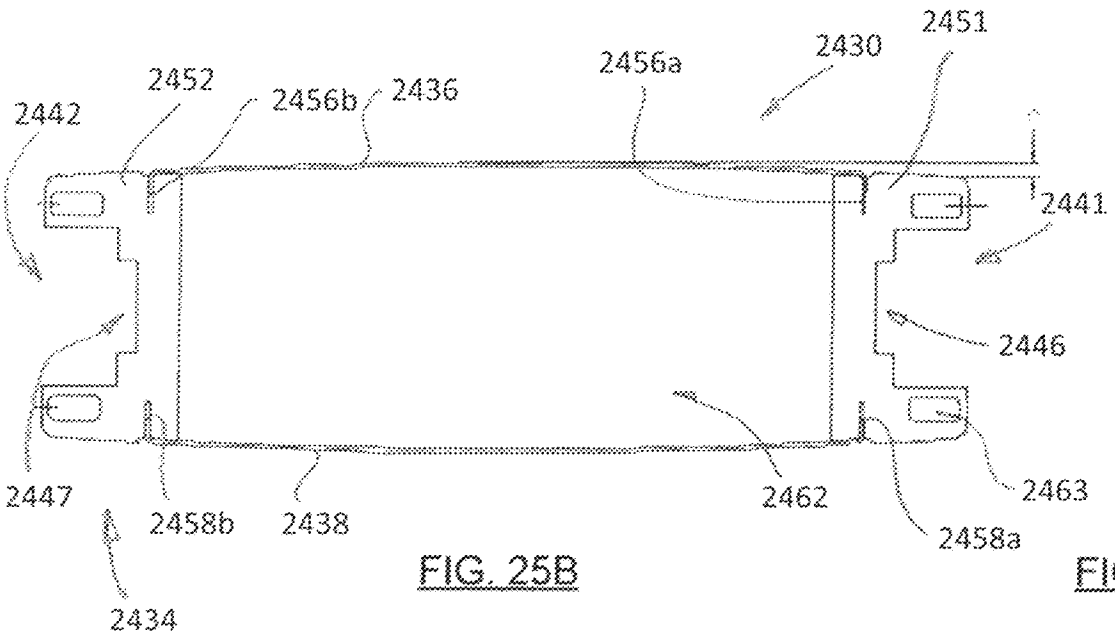
FIG. 25B is a plan view of the spacer of FIG. 24.
Figure 26A:
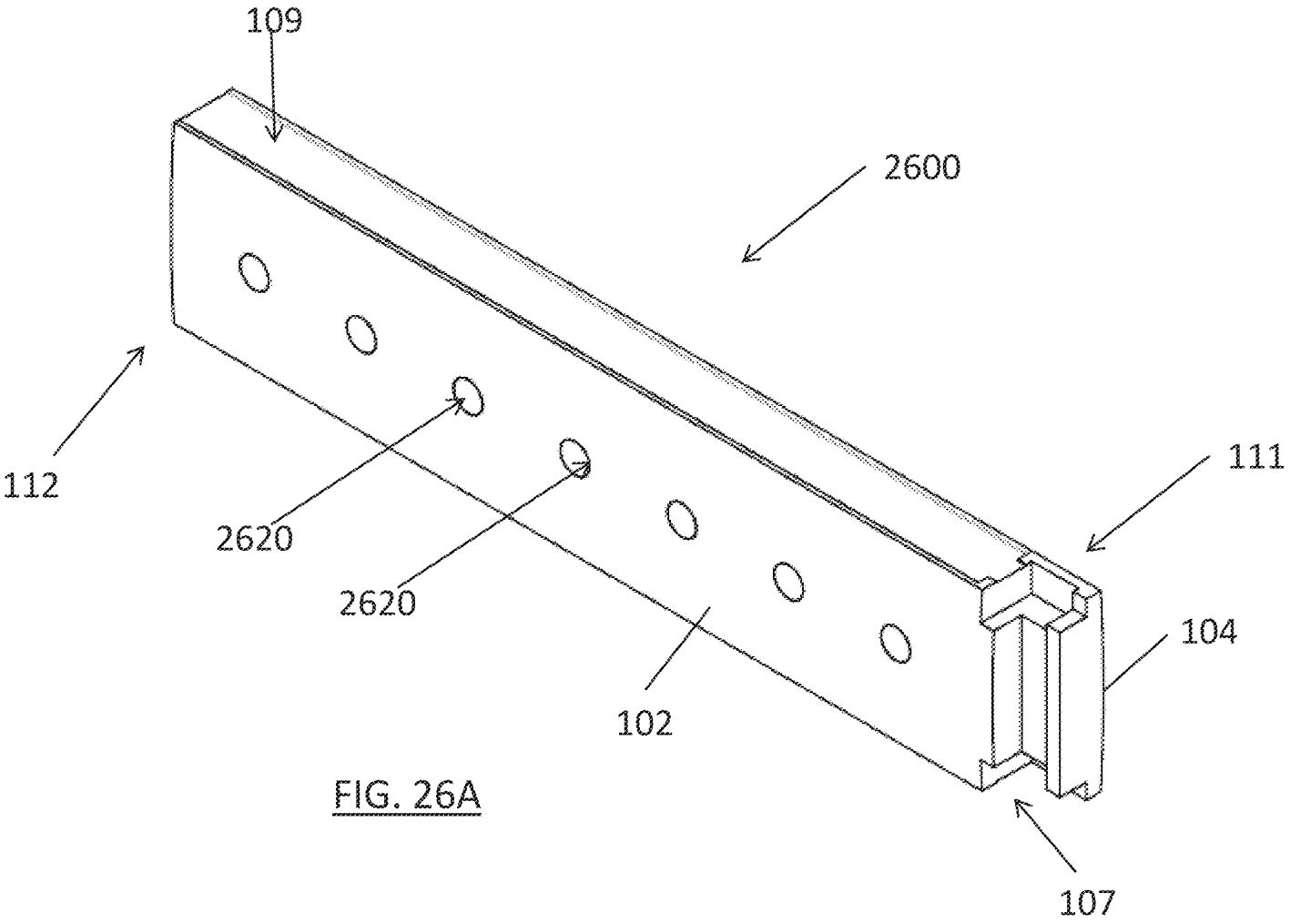
FIG. 26A is a perspective view of a part of a panel according to further embodiments.
Figure 26C:
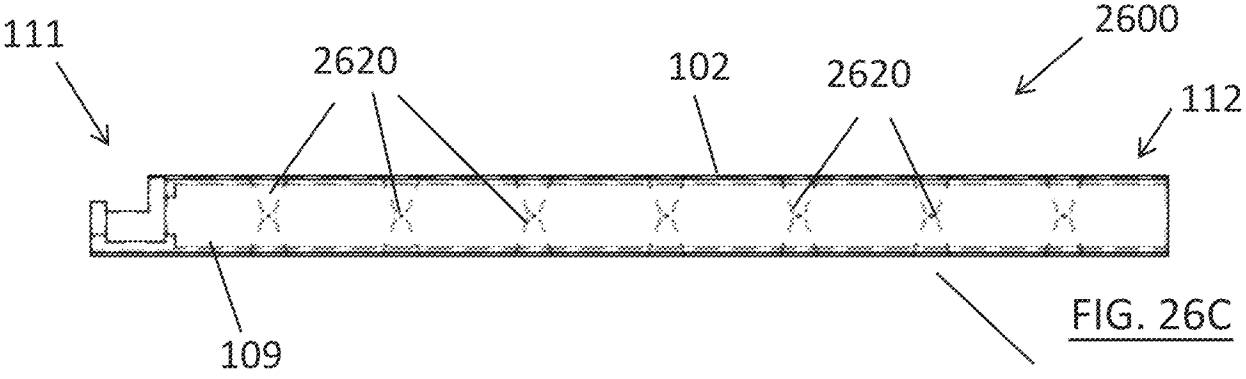
FIG. 26C is a side view of the panel of FIG. 26A.
Figure 26B:
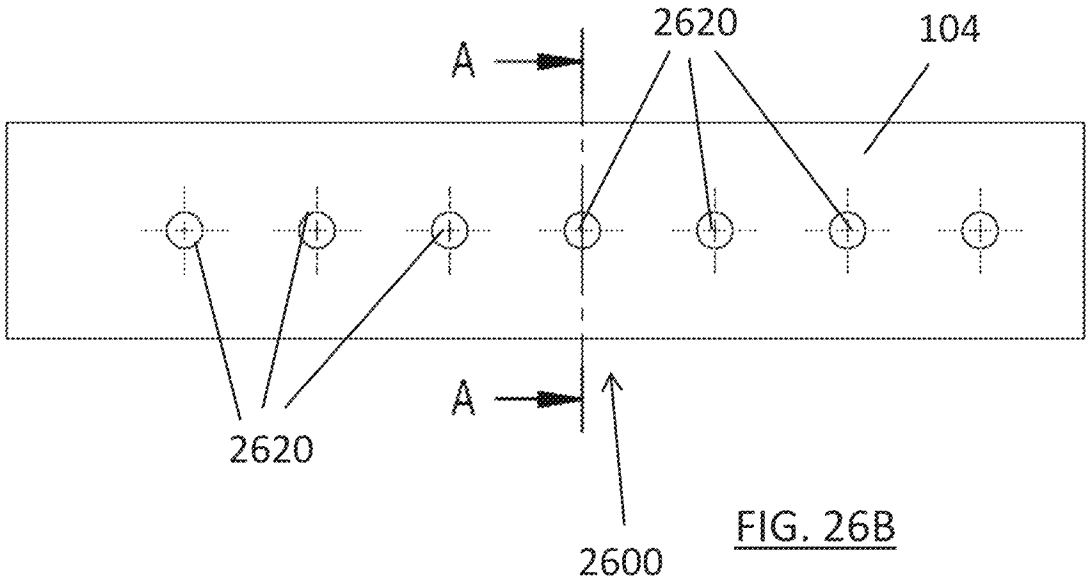
FIG. 26B is a cross-sectional end view taken along line A-A of the panel of FIG. 26A, showing the panel interior.
Figure 26D:
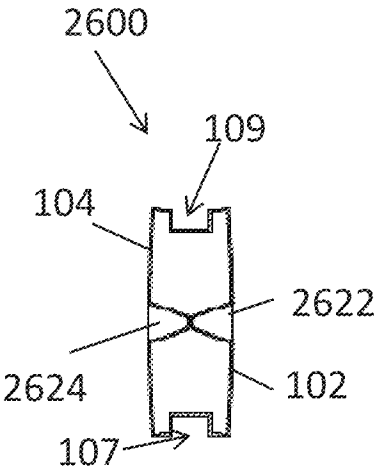
FIG. 26D is a cross-sectional end view taken along the line A-A of the panel of FIG. 26B, showing the panel interior.

Described panel embodiments employ supporting and/or reinforcing structure, for example including one or more rigid supporting elements or components 420, 421, 422 (FIG. 4A) that are external to the panel. Such supporting and/or reinforcing structure may comprise a number of strengthening or reinforcing elements, including for example: rigidifying variations in surface patterns; moulded or fabricated bridging or connection portions between the front and back walls; external horizontal support beams and one or more relatively rigid reinforcing elements (including spacers 1930, 2430, FIGS. 19 and 24) that extend within a cavity defined by the walls of the panel 100. Such reinforcing and/or spacing elements may comprise plastic components, metal components or both.

The panel 100 has a longitudinal centre-line that may be considered to coincide or lie parallel with a longitudinal axis of the panel 100. In some embodiments, panel 100 may be formed to have a width/height (i.e. distance between top and bottom edge faces 106, 108) different from that shown in FIG. 1A.

Embodiments of panel 100 may require strong structural integrity in order to be able to withstand high wind loadings, so a fixed rigid support frame 400 (FIG. 4A) may be used when panels 100 are mounted as part of a wall or barrier. In some embodiments, only one support frame 400 may be needed, while in other embodiments, plural or many support frames 400 may be arranged in series, for example with each sharing a fixed vertical support and each with plural panels 100 supported thereon. In some embodiments, a series of support frames 400 and panels 100 may extend for hundreds or thousands of meters.

Figure 4B:
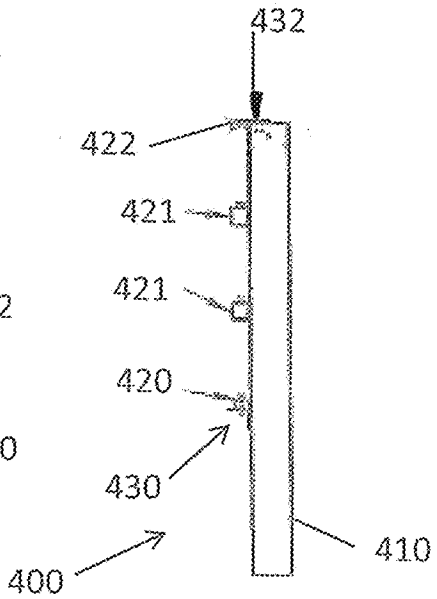
FIG. 4B is an end view of the support frame of FIG. 4A.
Figure 4A:
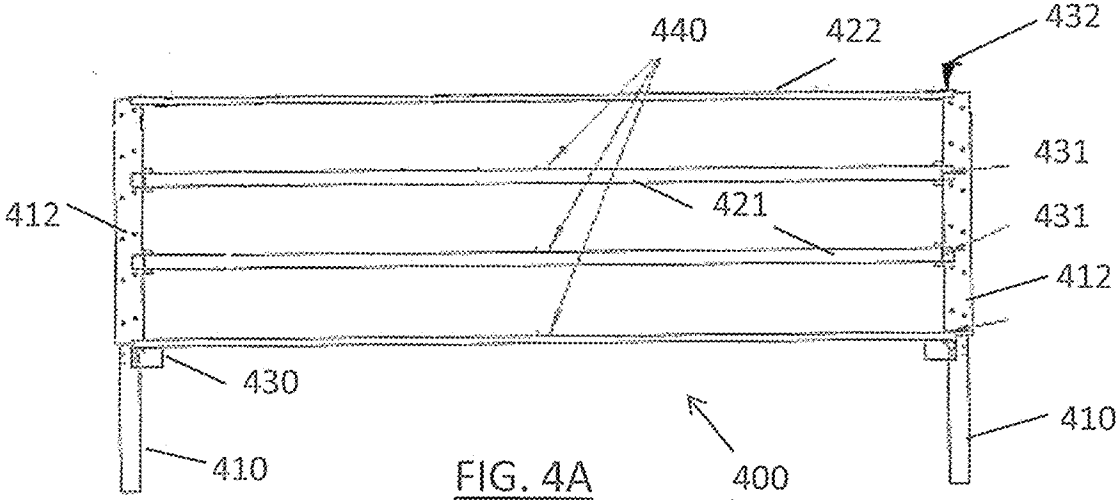
FIG. 4A is a front view of an assembled support frame to support multiple ones of the panel of FIG. 1A.
Figure 4C:
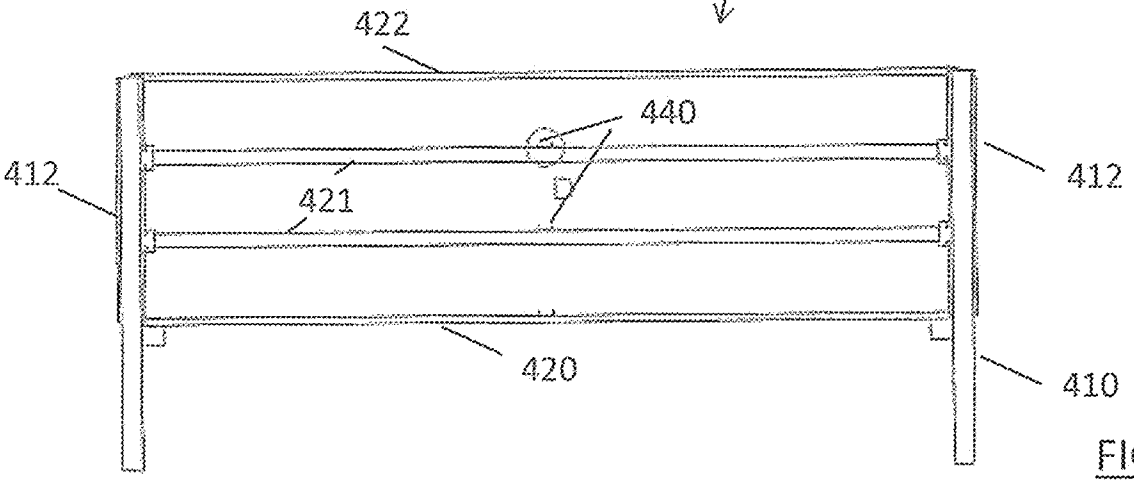
FIG. 4C is a back view of the support frame of FIG. 4A.

In some embodiments, the supporting and reinforcing structure comprises a plurality of elongate, generally strong and rigid beams or bars 420, 421, 422, which may be formed of steel or another suitable metal, such as Aluminium, for example. The structure and arrangement of the support frame 400 is shown in further detail in FIGS. 4A, 4B and 4C, as well as FIGS. 5 to 17. The elongate bar may be a steel square hollow section (SHS) or a rectangular hollow section (RHS), for example, or may in other embodiments be formed as an I-beam or other suitable beam shape.

In at least some embodiments, each panel 100 may be coupled to the support structure only by receipt of elongate bars 420, 421, 422 in respective recesses 107, 109, thus allowing for the plastic shell of the panel 100 to effectively move relative to the support structure, so that the functions and appearance of the support structure and the wall/barrier 500 are relatively unaffected by thermal expansion and/or contraction of the plastic shell of the panel 100 when panels 100 are mounted on support frame 400 as shown in FIGS. 5A to 5D, the panels 100 are substantially restricted from vertical and front/back (lateral) movement by the elongate bars 420, 421, 422 that sandwich each panel along the recesses 107, 109 in the top and bottom edge faces 106. Movement in a direction parallel with the longitudinal axis of the panel 100 is less restricted to allow for movement due to thermal expansion or contraction, but each panel is still limited in such longitudinal movement by abutment of part of the back face against a vertical support 410 at the first end 111 and against an end of an adjacent panel 100 at a same horizontal level (and supported by the same elongate bars 420, 421, 422) at the second end 112.

Figure 2:
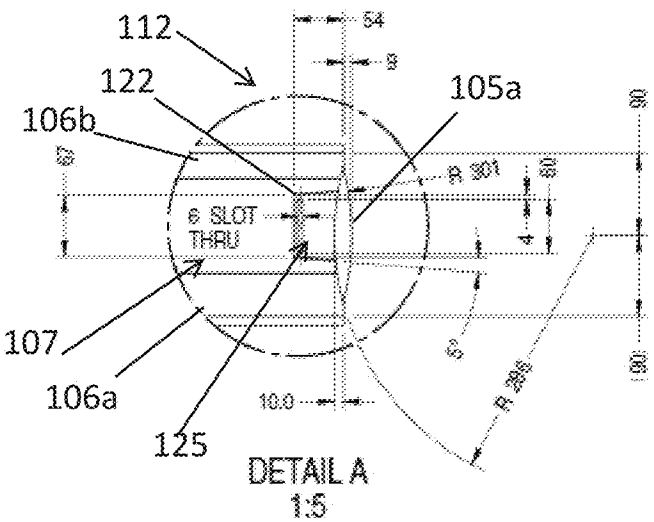
FIG. 2 is a detailed view of a portion A of the panel of FIG. 1B.

As shown in FIG. 2, each panel 100 may have locating means, for example in the form of further recessed portions 125, at the second end 112 to assist in substantially fixedly locating the second end 112 relative to the elongate bar 420, 421 that supports the panel 100. The recessed portions 125 are further recessed inwardly from the level of the longitudinal recesses 107, 109. Further recessed portions 125 may extend inwardly from the end face 105 by about 5 to 7 cm, for example. Such further recessed portions 125 are of a shallow depth and each define an aperture 122, which may be in the form of a slot or other shape, to receive a projecting boss or arm 443 or 445 of a locating bracket or cleat 440 that is affixed to a crossbeam 420 or 421 upon which the panel 100 is intended to rest. The receipt of the arm 443 or 445 in the aperture 122 serves to assist in positioning the panel 100 with respect to the supporting crossbeam 420 or 421. The further recessed portions 125 are located at the second end 112 of the panel 100 and are formed in both top and bottom longitudinal recesses 107, 109, so that the panel 100 can be positioned end-to-end with another such panel 100, whereby first ends 111 of each panel 100 are positioned adjacent vertical support structure and seconds ends 112 of each panel 100 are positioned closely adjacent to each other and each such panel has one of the arms 443, 445 of the locating cleat or bracket 440 received in a respective aperture 122. In this way, longitudinal expansion of each panel 100 can be allowed to occur in a direction outwardly from the relatively positionally fixed interface of the two adjacent second ends 112, thereby avoiding or minimising the possibility of a gap seeming to appear between the adjacent second ends 112 of the two panels 100 under the effects of thermal expansion.

Additionally, the end face 105 of the panel 100 has mating structure to allow the second ends 112 of adjacent panels 100 to nest and mate with each other while remaining physically unattached or not directly attached to each other. Such mating structure may include correspondingly shaped recesses and protrusions, such as a concave recessed portion 105*b* and convex protruding portion 105*a*. Such recessed portions 1051) and protruding portions 105*a* may be relatively shallow in profile, each extending along at least part of the end face 105, and may be protruding or recessed by a maximum of about 5 to 15 mm, for example. When panels 100 are positioned end-to-end with their second ends 112 positioned closely adjacent to each other, and with the front and back walls 104, 102 facing the same direction, the recessed portion 105*b* is shaped to receive a corresponding protruding portion 105*a* of the neighbouring panel 100. This mating structure assists in minimising the possibility of gaps being visible in the second ends 112 of adjacent panels 100. For improved sound attenuation purposes, thin sealing gaskets or strips may line parts of the end faces 105 of adjacent panels 100.

Panels 100 may be generally formed to have a substantially hollow interior and be substantially free of sections, portions or structure that join the front and back walls 104, 102, other than at the long edge faces 106, 108 and the first and second ends 111, 112. Such generally hollow panel structures can advantageously allow efficient formation thereof by rotational moulding, without the need for structural supports or thermal communication between the front and back walls 104, 102. Alternatively, as shown and described below in relation to FIGS. 19 to 21, some panel embodiments may employ one or more spacer elements 1930 to separate the front and back walls of the panel. In further alternative embodiments, the front and back walls 104, 102 of the panel may be connected at various locations along the panel's length by moulded or fabricated connection portions. Examples of such connections are shown and described in relation to FIG. 26.

As shown in FIGS. 4 to 7 and 9 to 17, support frames 400 according to described embodiments for forming walls or barriers 500 include vertical support structure, such as vertical beams or posts 410, and a plurality of crossbeams or bars 420, 421, 422 each extending between two of the (possibly many) spaced vertical beams 410. In some embodiments, such vertical beams 410 may have a facing plate 412 coupled to a front side thereof to provide greater surface area for clamping or otherwise affixing the crossbeams 420, 421, 422. In other embodiments, the facing plate 412 may be omitted.

Figure 7:
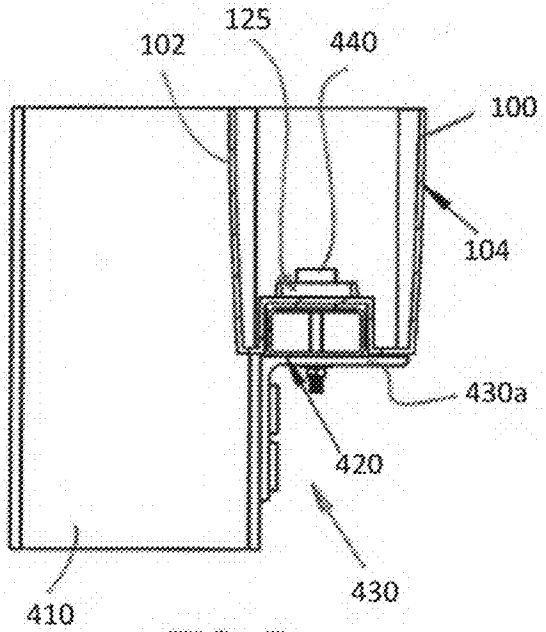
FIG. 7 is a cross-sectional view through part of the barrier of FIG. 5A, taken along line C-C of FIG. 5A and illustrating positioning of a lowest panel relative to a lowest support beam.
Figure 8:
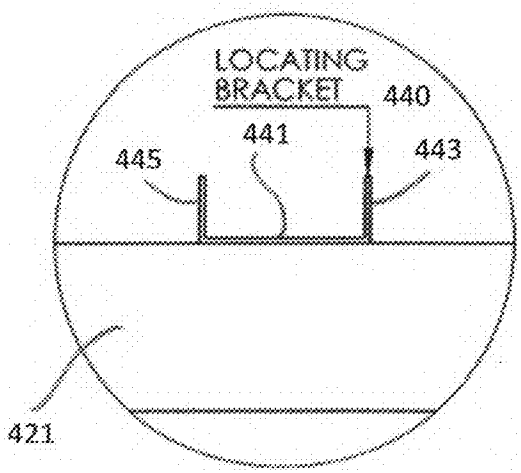
FIG. 8 is a detailed view of portion D of FIG. 4C, showing a locating support bracket on one of the support beams.

At a lowest position on the vertical beams 410 at which one of the crossbeams 420 is to be coupled, a specific coupling structure 430 is used to couple each end of the beam 420 to a respective vertical beam 410, for example at a flange 416 of the beam 410, as is best illustrated in FIGS. 7, 9 and 10. The coupling structure 430 may comprise a right angled plate 430*a* that is bolted, welded or otherwise fixedly coupled to the flange 416 on one (vertically disposed) face of the plate, while having one end of the lowest crossbeam 420 bolted to an upper face of the generally horizontally positioned portion of the angled plate 430*a*. One or more bolts 452 may be used to couple the crossbeam 420 to the angled plate 430*a*.

For cross-beams 421 that are to be coupled at positions on the vertical beam 410 higher than the lowest crossbeam 420, alternative coupling structure 431 can be employed. Coupling structure 431 is shown in further detail in FIGS. 11 to 14 and includes a clamping plate 470 and U-bolt 472 to clamp the central crossbeams 421 to a flange 416 of the vertical beam 410. In other words, coupling structure 431 relies on strong frictional engagement to retain crossbeams 420 in place on the vertical beams 410.

At an upper-most position at which an upper beam 422 is to be used to fixedly position the top panel or row of panels 100, a clamping structure 432 is used to affix the upper beam 422 at each end to respective vertical beams 410. The clamping structure 432, may be substantially similar to clamping structure 431 or clamping structure 430.

Lowest crossbeam 420 and upper crossbeam 422 may be sized to be fully or almost fully received within the upper or lower recess 109, 107 of an adjacent panel 100 and such crossbeams may thus be formed of a rectangular hollow section (i.e. metal tube) of lesser cross-sectional thickness compared to the central crossbeams 421 that are required to be simultaneously snugly received within adjacently positioned top and bottom recesses 109, 107 of respective vertically adjacent panels 100.

Referring now to FIGS. 5 to 14, embodiments of a barrier 500 are described in further detail. Barrier 500 comprises multiple panels 100 positioned one on top of the other and arranged to be lengthwise adjacent other panels 100 to form a series of vertically adjacent wall sections 502 along the length of barrier 500. In the example barrier 500 shown in FIGS. 5A to 5D, each wall has two vertically adjacent wall sections 502. While FIGS. 5A to 5D show barrier 500 comprising multiple panels 100 arranged end-to-end (extending substantially along a same longitudinal axis) on the same horizontal level, the barrier 500 may in some embodiments be formed using only a single panel 100 on each level. For embodiments of barrier 500 that comprise multiple panels 100 arranged end-to-end, the vertical support beams 410 may be spaced further apart than would otherwise be practical for single panels. For example, for two panels of roughly 3 metres in length positioned end-to-end, the vertical support beams 410 may be spaced apart by about 6 metres. For two panels 100 of about 4 metres in length, the vertical support beams 410 may be spaced apart by about 8 metres. For three panels 100 of about 3 metres in length, the vertical support beams 410 may be spaced apart by about 9 metres. For barriers or walls extending hundreds of meters or kilometres, significant cost-savings can be realised by needing to erect fewer vertical supports, since multiple plastic panels positioned end-to-end allow the vertical supports to be spaced further apart.

Some embodiments of panels 100 may employ non-parallel top and bottom edges and longitudinal recesses, for example giving each panel a somewhat trapezoidal appearance, with one end face 103 or 105 being longer than the other, providing such panels can still be tiled with each other to form a wall 500 or wall section 502. Such embodiments may cooperate with correspondingly angled support beams.

Barrier 500 comprises support structure to support the panels 100 in a vertical orientation with the long dimension of the panels 100 extending generally horizontally. The support structure may comprise multiple spaced beams, posts or girders which are anchored to the ground or a suitable alternative anchoring structure in a secure manner in order to lend suitable supporting structure so that large wind forces impinging on the panels 100 are unlikely to displace or perturb the attached panels 100 and wall sections 502. I-beams 410*a*, 410*b* and 410*c* (FIG. 17) are shown as examples of at least part of such support structure. Although anchoring structure is not shown, such I-beams 410 may be anchored into the ground by suitable footings, for example, using concrete.

As shown in FIGS. 4A, 4B, 4C and 11 to 14, the barrier 500 further comprises clamping structure 431 to couple cross-beams 420 to the I-beam 410 and thereby indirectly couple each panel 100 to the I-beam 410. Such clamping structure 431 is one form of attachment means that may be used to attach each cross-beam 420, and thereby each panel 100, to the support structure. Other forms of attachment means may be employed, such as bolts that extend through flanges of the I-beam 410 in a bolted attachment arrangement 430. The bolted attachment arrangement 430 may be employed to more securely locate the lowest beam 420 against the I-beam 410 since it may need to support the weight of multiple panels above. The clamping structure 431 allows the cross-beams 421 to be coupled to the flange 416 of separate spaced I-beams 410 without penetrating the flange 416, which saves time and cost.

Clamping structure 431 comprises a clamping plate 470 and a U-bolt 472. Clamping plate 470 and U-bolt 472 are shown in further detail in FIGS. 11 to 14. The clamping plate 470 has a right angle bend at one end of an otherwise generally flat rectangular metal plate-like body. A shallow flange projects from the right angle bend so that the flange can be positioned against a surface of the beam 421, 422 and the other end of the clamping plate 470 lies flat against an inside of one flange 416 of the I-beam 410, with the U-bolt 472 extending around the beam 421, 422. Opposed arms of the U-bolt 472 extend through apertures formed in between the flanged and non-flanged ends of the clamping plate 470 to pull the beam 421, 422 against the I-beam 410 by tightening nuts 474 on each arm of the U-bolt 472.

Coupling structure 431 is configured to clamp support beams 421 to a flange 416 of an I-beam 410. As is shown best in FIGS. 9 and 10 and described below, a slightly different coupling structure 430 may be used to couple support beam 420 to a lower position on the flange 416 of the I-beam 410 by using bolts (or other attachment means not relying on friction) and a right-angled plate 430*a*.

Figure 6:
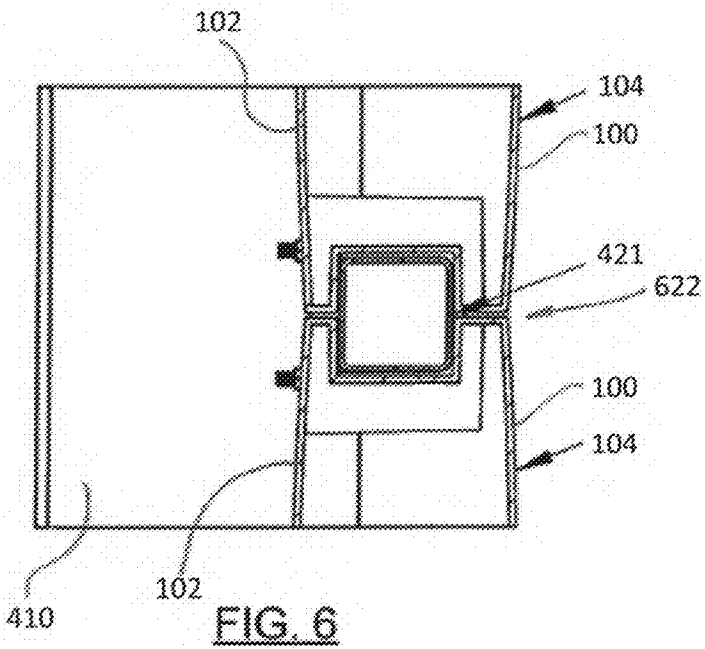
FIG. 6 is a sectional view of part of the barrier of FIG. 5A, taken along line A-A of FIG. 5A and illustrating positioning of two panels relative to a support, beam.

As shown in FIG. 6, cross bars 421 and top and bottom longitudinal recesses 109, 107 are sized to generally snugly mate with each other so that a bottom recess 107 generally nests and mates with a top part of the cross bar 421 and the top recess 109 generally nests and mates with a bottom part of the cross bar 421, with the effect that the cross bar 421 is generally surrounded by the recess-defining walls of the two adjacent panels 100 and is substantially hidden from view. However, the depth of the top and bottom longitudinally recesses 109, 107 is dimensioned so that a small horizontally extending gap 622 remains between the adjacent outer surfaces of the long edge faces (106*a*, 108*a* toward the front and 106*b*, 108*b* toward the back) of the adjacent panels 100. This gap 622 may be in the order of 3 to 10 millimetres, for example. Gap 622 is intended to allow for a degree of thermal expansion of the front or back panel walls and is present between neighbouring panel surfaces 106*a*, 108*a* adjacent to the front panel walls 104 and between surfaces 106*b*, 108*b* adjacent the rear walls 102 of the panels 100.

Figure 17:
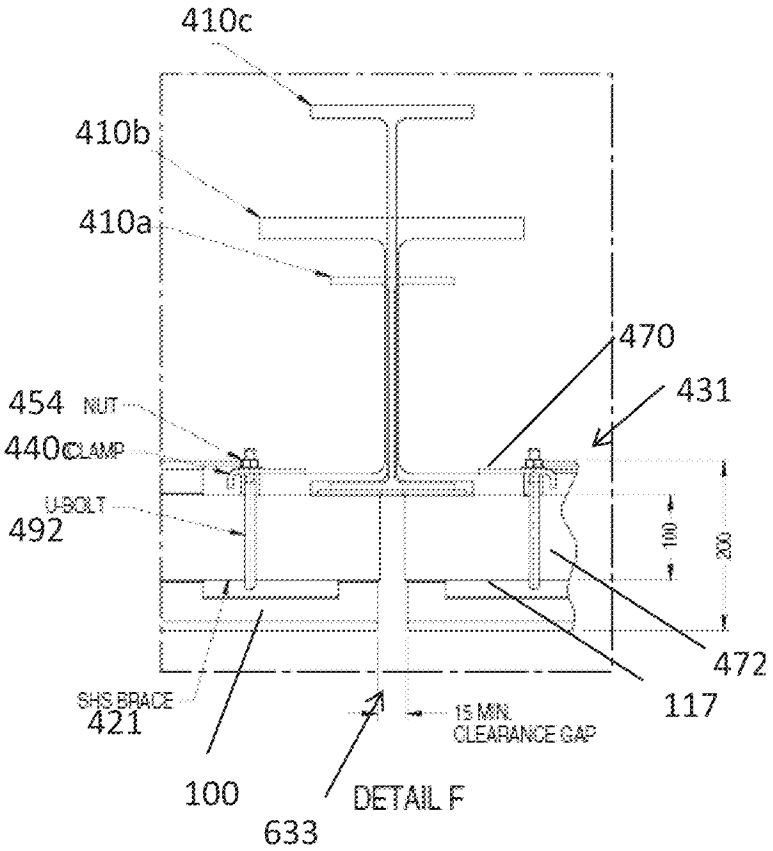
FIG. 17 is a plan view of section F of FIG. 16, showing alternative vertical support beams that can be used in described barriers.

While gap 622 allows for vertical thermal expansion of the panels 100, a vertically extending gap 633 is also left between adjacent first panel ends 111, as shown in FIG. 17, to allow for horizontal (longitudinal) thermal expansion. Gap 633 is sized to be larger than gap 622, since there is greater potential for thermal expansion in the longitudinal direction because of the much greater amount of plastic panel wall material extending in that direction. Gap 633 may be in the order of about 10 to about 50 millimetres, and possibly about 10 to 20 millimetres, for example.

Figure 16:
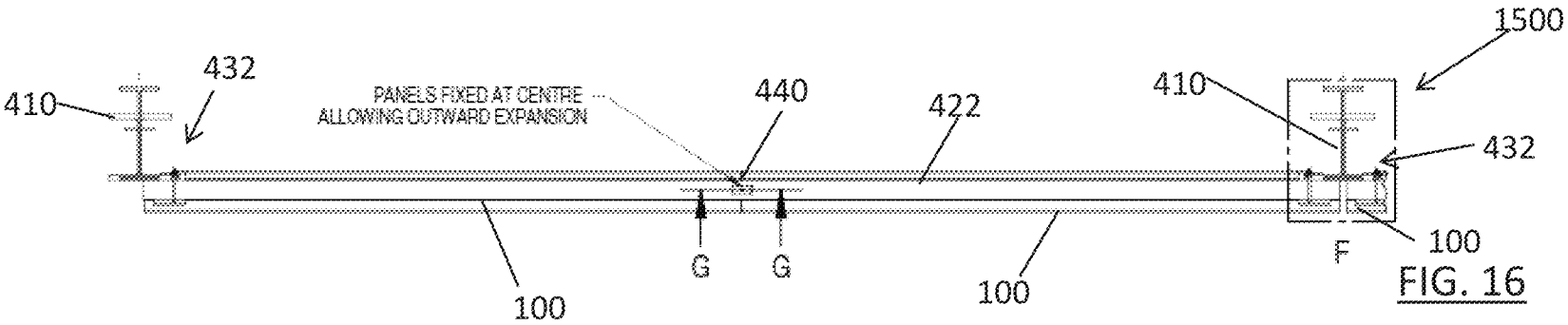
FIG. 16 is a plan view of the barrier of FIG. 15.
Figure 15:
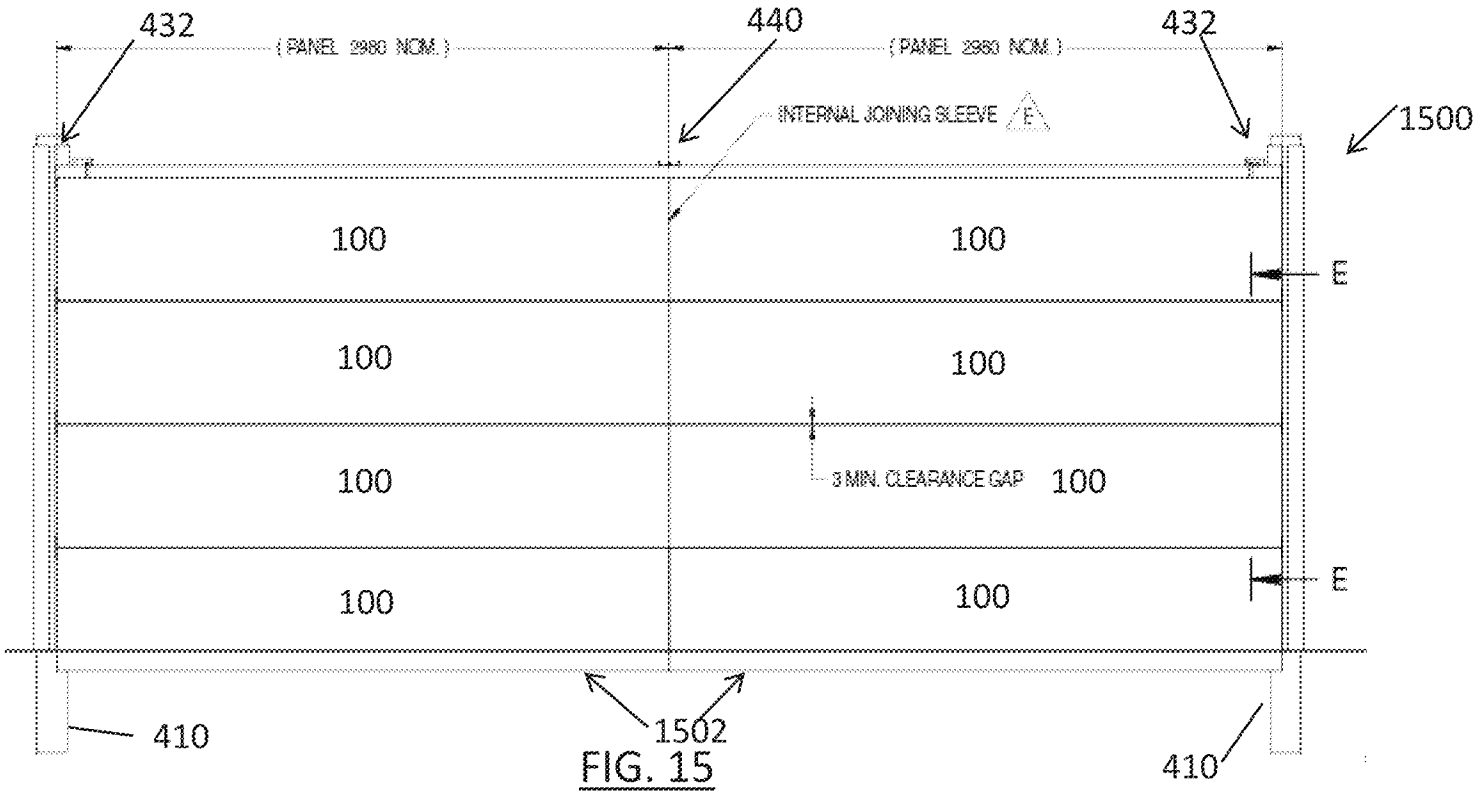
FIG. 15 is a front view of a barrier according to further embodiments.

Referring also to FIGS. 15, 16 and 17, further embodiments of a wall or barrier portion 1500 are described. Such wall or barrier portions 1500 employ a series of panels 100 tiled together and supported by a support framework that is essentially the same as framework 400 but for the addition of another crossbeam 420. Wall or barrier portion 1500 illustrated in FIG. 15 shows the tiling of eight panels 100, with two panels 100 arranged on each of four vertically stacked rows, with each vertical stack of panels 100 forming a wall section 1502. The wall or barrier portions 500 shown in FIGS. 5A to 5D illustrate a similar arrangement, but with three vertically stacked rows of two panels 100. In other embodiments, a greater number, such as five, six, seven, eight, nine or ten, of vertically stacked rows of panels 100 may be employed to provide a wall or barrier portion 500 or 1500 of greater height. Alternatively, a lesser number of rows, such as two or one, may be employed. In other embodiments, only a single wall section 1502 may be supported intermediate the support beams 410.

Figure 5A:
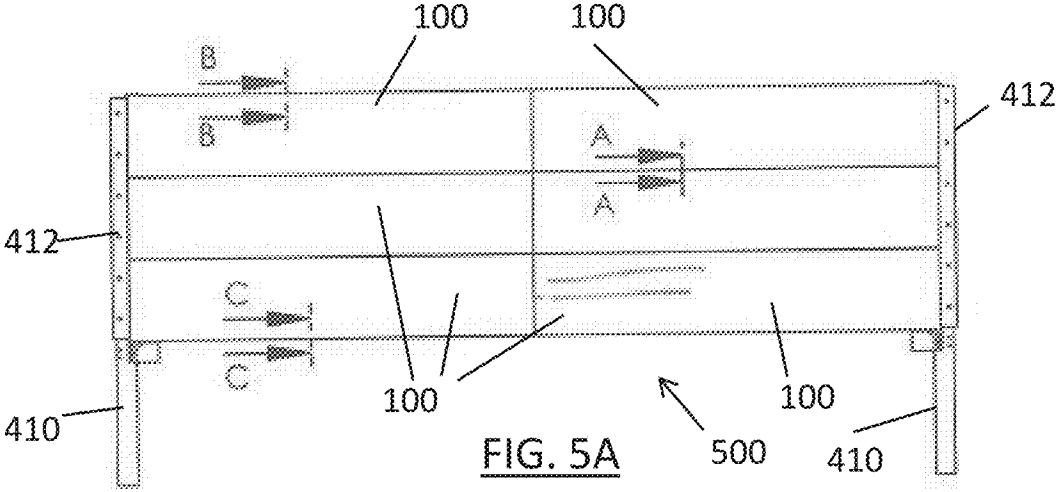
FIG. 5A is a front view of a barrier comprising the support frame of FIG. 4A and multiple ones of the panel of FIG. 1A.
Figure 5B:
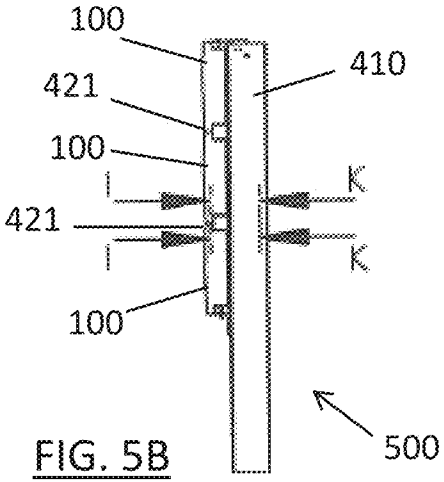
FIG. 5B is an end view of the barrier of FIG. 5A.
Figure 5C:
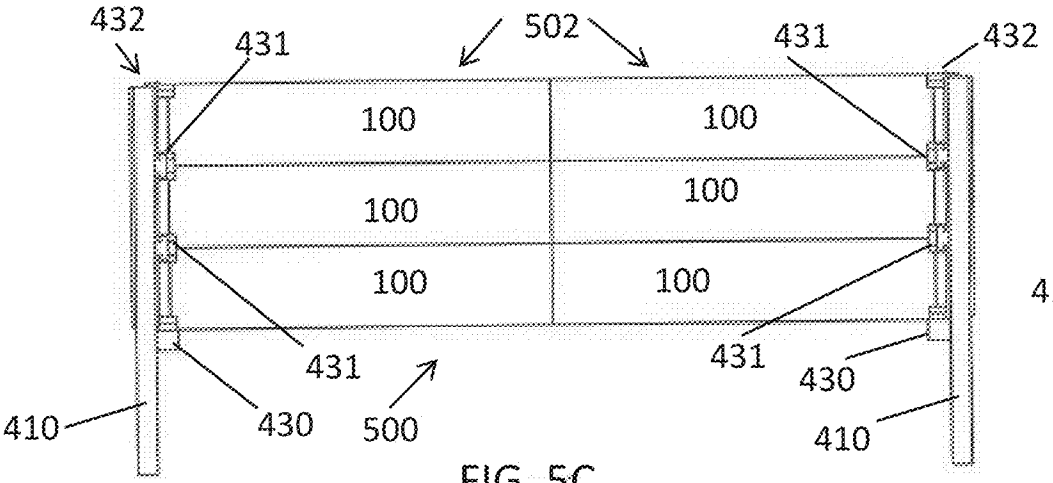
FIG. 5C is a back view of the barrier of FIG. 5A.
Figure 5D:
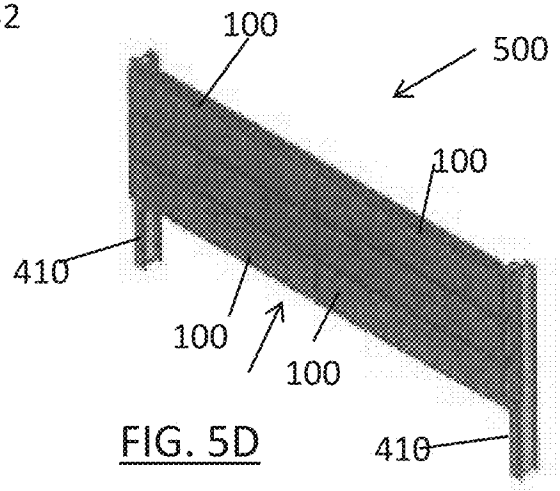
FIG. 5D is a perspective view of the barrier of FIG. 5A.

FIGS. 16 and 17 illustrate how the panels 100 can be coupled to vertical beams 410 of varying dimension and flange size. For example, a small beam 410*a* with small flange size may be coupled with an expansion plate 412, as shown in FIG. 5A, that may be bolted or welded on to the flat outer end face of the beam 410*a*. Alternatively, larger beam sizes 410*b* and 410*c* may not require the use of an expansion plate 412. Recesses 117 formed in the first end 111 of each panel 100 are relatively shallow to accommodate the diameter of the U-bolt 472 as part of the clamping arrangement 431, but such recesses 117 have a longitudinal length sufficient to permit variation in position of the U-bolt 472, depending on the length of the flange 416 to which the clamping mechanism 431 is coupled. For example, for a longer length of flange 416, the coupling mechanism 431 may be positioned further away from end face 103 and thus recesses 117 are of sufficient length to allow such further positioning of U-bolt 472 away from end face 103 without interference.

Figure 18:
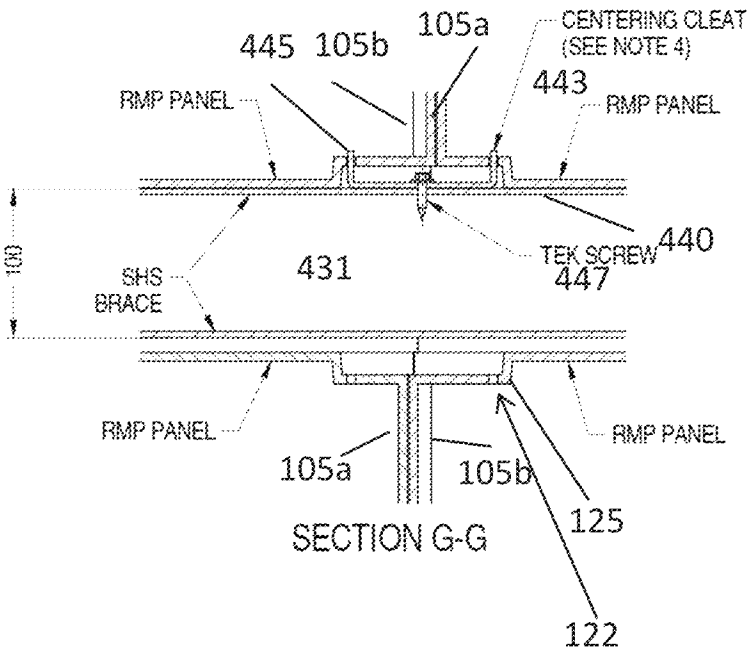
FIG. 18 is a sectional view along line G-G of FIG. 16, showing use of an example centering cleat for panel positioning.

FIG. 18 is a cross-sectional view along line G to G of FIG. 16 and shows how the centering cleat or bracket 440 is used to position adjacent ones of panels 100 with respect to an approximate longitudinal midpoint of a cross bar 421. Each such centering cleat or bracket 440 may be formed approximately in a U shape, so that locating arms 433, 445 project upwardly from opposite sides of a base portion 440. The base portion 440 may be bolted or screwed on to the cross bar 421 by a fastener 447 or alternatively welded on.

In some embodiments, a different panel construction may be employed. This different panel construction is shown and described with reference to FIGS. 19, 20, 21A and 213 as panel 1900. The panel 1900 is similar in external shape, appearance and profile to panel 100, having front and back panel walls 1904, 1902, opposite first and second ends 1911, 1912 and top and bottom recessed portions 1909, 1907. However, panel 1900 also comprises at least one truss or spacer 1930 positioned within an internal cavity of the panel 1900. The truss or spacer 1930 is preferably bonded, coupled or otherwise affixed to internal parts or wall surfaces of the front and back panel walls 1904, 1902. The positioning of the spacer 1930 within the panel walls is most easily seen in FIG. 19.

Figures 19, 20, 21A, 21B:
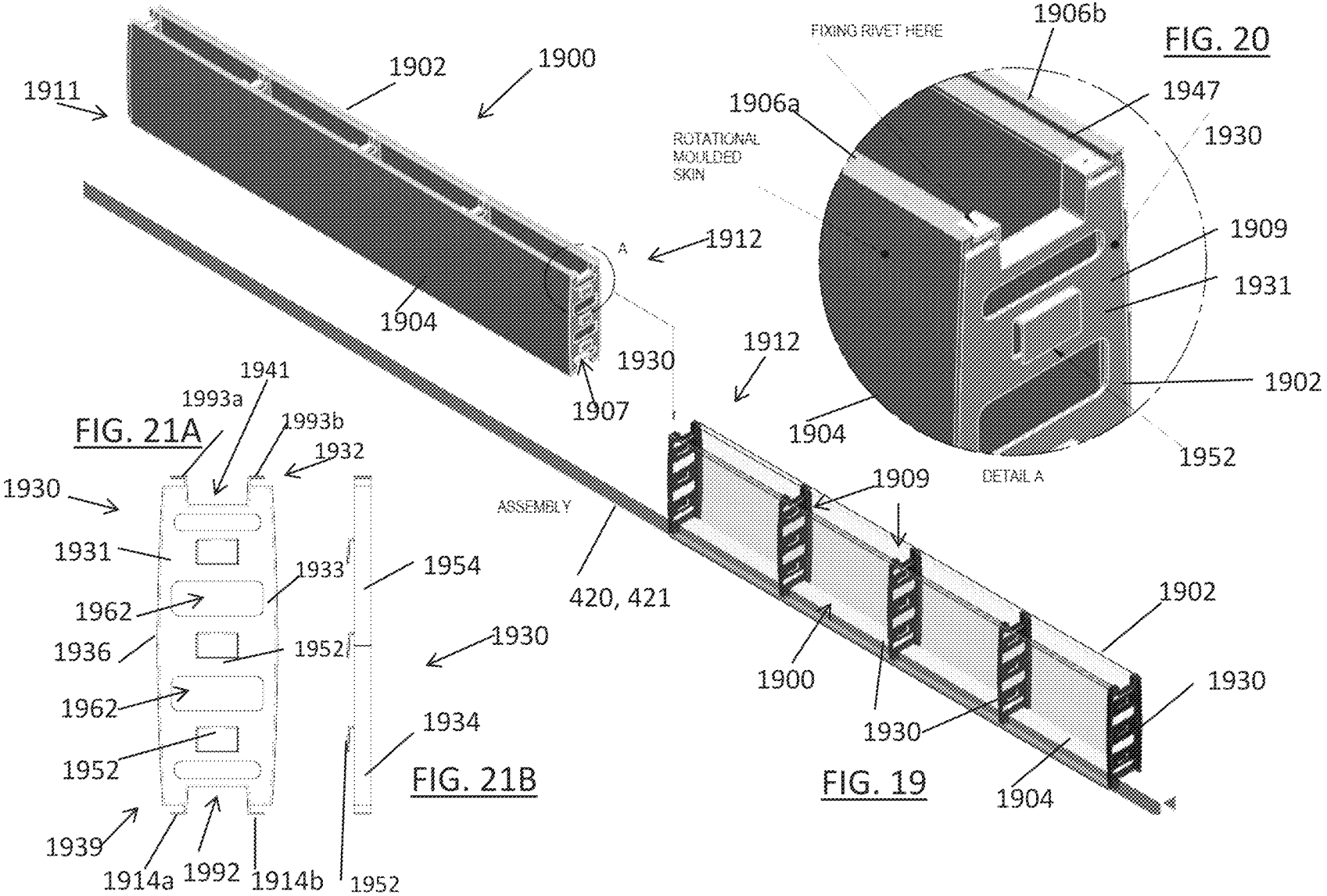
FIG. 19 is an isometric view of an alternative panel and barrier assembly according to some embodiments.
FIG. 20 is a close-up view of detail A of FIG. 19.
FIG. 21A is an elevation view of a spacer for use in the panel of FIG. 19.
FIG. 21B is a side view of the spacer of FIG. 21A.

An example spacer 1930 is shown in more detail in FIGS. 21A and 21B. The spacer 1930 is sized and configured to be disposed in between the front and back panel walls 1904, 1902, in order to separate the front and back panel walls 1904, 1902 and allow different amounts of thermal expansion or contraction at the front or back of the panel, for example due to greater sunlight on one side than the other. Additionally, the spacer 1930 performs a reinforcement function since it acts as a relatively rigid bridging structural element between the front and back side walls 1904, 1902. Each spacer 1930 defines first and second opposed recesses 1941, 1942, each sized to receive one of the elongate bars 420, 421, 422 and allow the panel 1900 to be held in position by respective elongate bars 420, 421 or 422 that are fixed in position on spaced vertical supports 410. Thus, the spacers 1930 effectively carry the front and back panel walls 1904, 1902 and serve to partly or fully define the top and bottom recessed portions 1909, 1907 that mate with the panel support structure (i.e. cross-beams 420, 421, 422). Some sliding of the spacer 1930 along the elongate bar 420, 421 or 422 may occur during positioning of the panel 1900 on the bar 420, 421 or during any thermal expansion or contraction of the panel walls.

Each spacer 1930 has a generally planar web 1931, opposite first and second ends 1932, 1934 and first and second opposed (slightly convex) side portions 1936, 1938, which all-together connect and thereby define the external truss shape that separates the panel walls 1902, 1904 and accommodates the elongate bar 420, 421, 422. The spacer 1930 may, in some embodiments, be formed of a material that is chemically compatible with the plastic material used to form the shell of the panel.

The spacer 1930 may have a length (height) from the first end 1932 to the second end 1934 that is slightly less than the height of the front and back panel walls 1904, 1902 when the panel 1900 is in the upright position shown in FIG. 19. The maximum lateral width of the spacer 1930 (which defines the separation of the front and back panel walls 1904, 1902) may be about 150 to about 250 millimetres or possibly about 180 to about 210 millimetres, for example, depending on the desired lateral width (thickness) of the panel 1900. The maximum thickness of the spacer 1930 (as seen side-on in FIG. 21B) may be about 10 to about 30 millimetres, for example. These dimensions may be varied according to some embodiments, depending on the panel height and desired lateral separation of the front and back panel walls 1904, 1902.

The spacer 1930 may be formed of, or comprise, a plastic material compatible with the plastic material of the panel walls 1902, 1904. For example, the spacer 130 may be formed of a suitable polyolefin, such as a suitable polyethylene or polypropylene material having an appropriate melting point, stiffness and strength for use in a barrier of the type described. In alternative embodiments, the spacer 1930 may be formed of, or comprise, non-plastic materials, such as metals. For example, the spacer 1930 may be formed of, or comprise, light steel or aluminium. Further, the shape of spacer 1930 shown in the drawings and described above may be modified while still performing the same spacing and reinforcement functions as described herein. For example, the spacer 1930 may have side portions 1936, 1938 that have a different, non-convex profile.

The spacer 1930 has opposed flange portions 1943*a* and 1943*b* that extend upwardly and outwardly from adjacent the first recess 1941. Each such flange portion 1943*a*, 1943*b* has an aperture 1947 formed in a surface thereof to allow coupling of that flange portion 1943*a*, 1943*b* to an inwardly projecting flange 1906*a*, 1906*b*, respectively of the front and back wall panels 1904, 1902. A suitable fastener may be used to couple the spacer flanges 1943*a*, 1943*b* to the wall panel flanges 1906*a*, 1906*b* and such a suitable fastener may include a rivet, screw, bolt or clamp, for example. The spacer 1930 has a similar projecting flange arrangement at its opposite end 1934, so that projecting flanges 1944*a* and 1944*b* can coupled to lower projecting flanges (not shown in FIG. 19) of the front and back wall panels in a similar manner to that shown in relation to upper projecting flanges 1906*a*, 1906*b*. Similarly, spacer flanges 1944*a*, 1944*b* at a bottom end 1934 of the spacer 1930 project outwardly away from recess 1942 and each such flange comprises apertures 1947 to receive a fastener or comprises or cooperates with other coupling means to couple the spacer 1930 to the lower inwardly projecting flanges of the front and back wall portions 1904, 1902.

The web 1931 of each spacer 1930 may have a series of hooked portions 1952 formed thereon to hook on to inversely positioned hooked portions 1952 of a neighbouring spacer 1930, where such spacers 1930 are positioned to act as an end face at adjacent second ends 1912 of panels 1900 that are to be positioned end-to-end. Such hooked portions 1952 can serve to effectively couple such adjacently positioned panels 1900 together. However, coupling structures other than hooked portions 1952 may be employed to similar effect. In particular, the corresponding recessed and mating portions shown and described in relation to FIGS. 1A, 1B, 1C and 2 may be used to fit adjacent ends 1912 together in a suitable complimentary mating fashion.

Web 1931 may have a series of apertures 1962 at spaced positions along the length and width of the spacer 1930 in order to reduce the amount of material needed to form the spacer 1930. The spacer 1930 may have an outer peripheral flange 1954 that extends all the way around the outer periphery of the web 1931 to provide additional structural integrity to the spacer 1930. The outer peripheral flange 1954 may extend laterally in one or both directions from the plane of the web 1931.

Some embodiments of panel 1900 may use an alternative spacer 2430 instead of spacer 1930. Spacer 2430 is illustrated in further detail in FIGS. 24, 25A, 25B and 25C. The spacer 2430 is sized and configured to be disposed in between the front and back panel walls 1904, 1902, in order to separate the front and back side walls 1904, 1902 and allow different amounts of thermal expansion or contraction at the front or back of the panel, for example due to greater sunlight on one side than the other. Additionally, the spacer 2430 performs a reinforcement function since it acts as a somewhat rigid yet flexible bridging structural element between the front and back side walls 1904, 1902.

Each spacer 2430 defines first and second opposed recesses 2441, 2442, each sized to receive one of the elongate bars 420, 421, 422 and allow the panel 1900 to be held in position by respective elongate bars 420, 421 or 422 that are fixed in position on spaced vertical supports 410. Thus, the spacers 2430 effectively carry the front and back panel walls 1904, 1902 and serve to partly or fully define the top and bottom recessed portions 1909, 1907 that mate with the panel support structure (i.e. cross-beams 420, 421, 422). Some sliding of the spacer 2430 along the elongate bar 420, 421 or 422 may occur during positioning of the panel 1900 on the bar 420, 421 or during any thermal expansion or contraction of the panel walls. Recesses 2441 and 2442 each have a detent 2446, 2447 defined to extend inwardly from the spacer ends and thereby allow a small air gap to be present between the elongate bar 420, 421 or 422 and a bridging section of an end part 2451. This air gap assists to reduce material deterioration that might otherwise occur between the bridging section and the elongate bar 420, 421 or 422.

Each spacer 2430 has a generally similar convex external profile to spacer 1930, including opposite first and second ends 2432, 2434 (having respective first and second end portions 2451, 2452) and first and second opposed (optionally slightly convex) side portions 2436, 2438, which connect and thereby define the external truss shape that separates the panel walls 1902, 1904 and accommodates the elongate bar 420, 421, 422. The spacer 2430 may be formed with end parts 2451, 2452 of a first material, such as a moulded plastic, and side portions 2436, 2438 of a second material, such as a spring steel. If the side portions 2436, 2438 are formed of a flexible material, such as a spring steel, then they may be formed as thin bars having a slight curvature as shown and having a generally uniform thickness and a width of around 10 to 30 mm, for example.

The spacer 2430 may have a length (height) from the first end 2432 to the second end 2434 that is slightly less than the height of the front and back panel walls 1904, 1902 when the panel 1900 is in the upright position shown in FIG. 19. The maximum lateral width of the spacer 2430 (which defines the separation of the front and back panel walls 1904, 1902) may be about 150 to about 250 millimetres or possibly about 180 to about 210 millimetres, for example, depending on the desired lateral width (thickness) of the panel 1900. The maximum thickness of the spacer 2430 (as seen side-on in FIG. 25A) may be about 10 to about 30 millimetres, for example. These dimensions may be varied according to some embodiments, depending on the panel height and desired lateral separation of the front and back panel walls 1904, 1902.

The spacer 2430 has opposed end projection portions 2443*a* and 2443*b* that extend longitudinally outwardly from adjacent the first recess 2441 in end portion 2451. Each such end projection portion 2443*a*, 2443*b* has an aperture 2467 formed in a surface thereof to allow coupling of that end projection portion 2443*a*, 2443*b* to an inwardly projecting flange 1906*a*, 1906*b*, respectively of the front and back wall panels 1904, 1902. A suitable fastener may be used to couple the spacer end projections 2443*a*, 2443*b* to the wall panel flanges 1906*a*, 1906*b* and such a suitable fastener may include a rivet, screw, bolt or clamp, for example. The spacer 2430 has a similar end projection arrangement at its opposite end 2434, so that end projections 2444*a* and 2444*b* can be coupled to lower projecting flanges (not shown in FIG. 19) of the front and back wall panels 1904, 1902 in a similar manner to that shown in relation to upper projecting flanges 1906*a*, 1906*b*. Similarly, spacer end projections 2444*a*, 2444*b* at a bottom end 2434 of the end portion 2452 of the spacer 2430 project outwardly away from recess 2442 and each such end projection 2444*a*, 2444*b* comprises apertures 2467 to receive a fastener to couple the spacer end portion 2452 to the lower inwardly projecting flanges of the front and back wall portions 1904, 1902.

Each of the first and second end portions 2451, 2452 may have one or more apertures 2463 at spaced positions around the respective end portions 2451, 2452 in order to reduce the amount of material needed to form the spacer end portions 2451, 2452.

The convex side portions 2436, 2438 of the spacer 2430 may be coupled to each of the end portions 2451, 2452 by one or more of several different coupling mechanisms, including but not limited to: frictional engagement, interference fit, a snap-fitting, cooperating projections and recesses, adhesives, fasteners or moulding, for example. In the embodiment shown in FIGS. 25A to 25C, the side portions 2436, 2438 are coupled to each of the end portions 2451, 2452 by an interference fit of inward end projections 2456*a*, 2456*b* (for the first side portion 2436) and 2458*a*, 2458*b* (for the second side portion 2436) within a suitably sized narrow slot in each lateral side of the bridge portion of each of the end portions 2541, 2542.

For each panel 1900, at least one spacer 1930 or 2430 may be positioned roughly mid-way between the ends 1911, 1912 of the panel 1900. Preferably, at least two more spacers 1930 or 2430 are positioned along the inside of the panel 1900 intermediate the centrally positioned spacer 1930/2430 and each end of the panel 1900. In various embodiments, 2, 3, 4, 5, 6, 7, 8, 9, 10 or more spacers 1930 or 2430 may be positioned inside the panel walls. In some embodiments, the panel 1900 may comprise at least one spacer 1930, for example positioned at one or both ends 1911, 1912, and at least one spacer 2430, for example positioned at positions intermediate the ends 1911, 1912.

Figure 22:
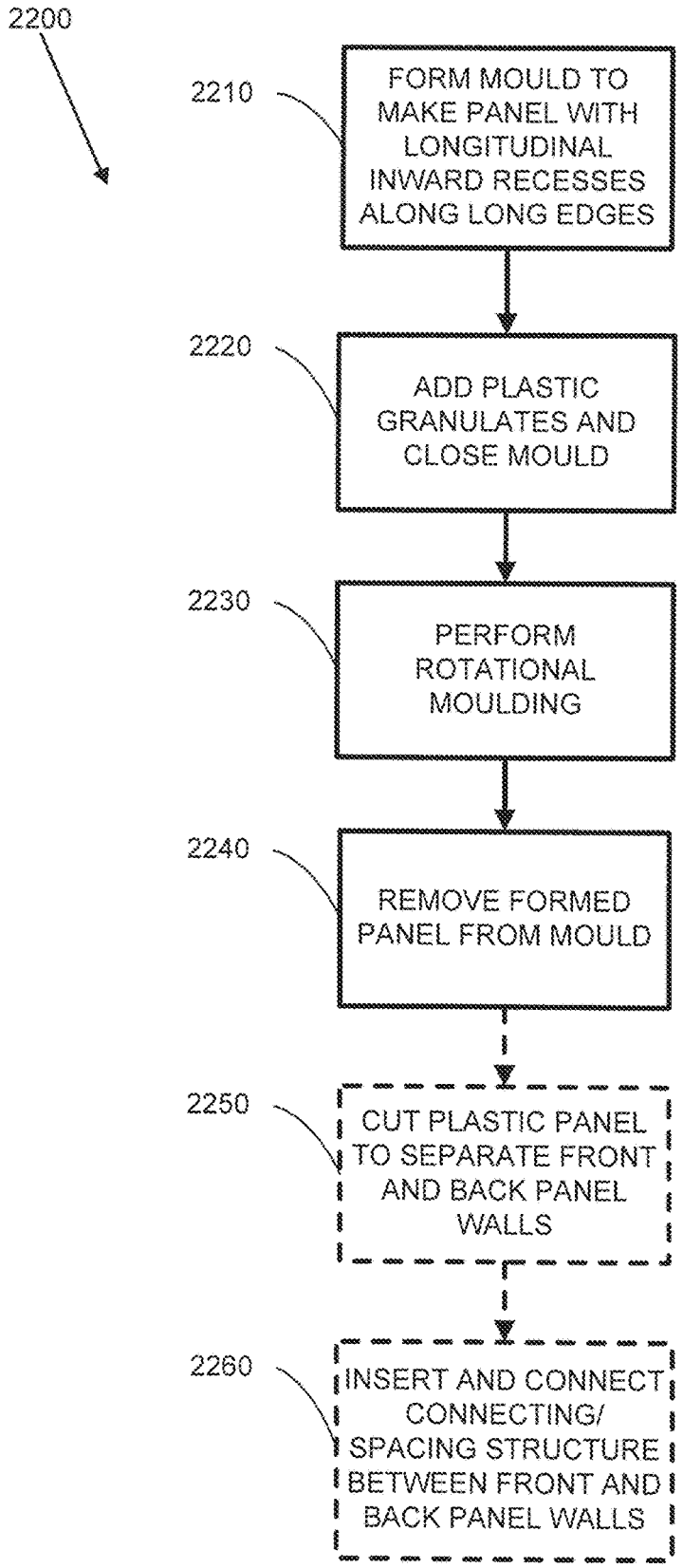
FIG. 22 is a flow chart of a method of forming a plastic panel according to some embodiments.

Referring now to FIG. 22, a method 2200 of forming a wall panel is described in further detail. At step 2210, a mould is formed. The mould must be suitable for use in rotational moulding and may be formed of machined aluminium plates, for example. The mould plates are preferably formed to have substantial uniform thickness from the back face of the mould to the front face of the mould in order to allow relatively uniform heat transmission through the material of the mould. Thus, where a particular design, texture, pattern and/or set of symbols is applied to the mould, both front and back faces of the mould plate should be machined accordingly.

The mould plates are formed at 2210 to define a hollow panel when moulded, having a length greater than a width, a thickness less than the width, a front wall, an opposite back wall and opposed first and second long edge regions. The panel shape thus defined has a first end and a longitudinally opposite second end, with the first long edge region defining at least one first recessed portion 107 or 1907 to longitudinally receive and mate with a first longitudinal support structure (beam 420 or 421) and the second long edge region defining at least one second recessed portion 109 or 1909 to longitudinally receive and mate with a second longitudinal support structure (beam 421 or 422).

At step 2220, granules of a suitable polyolefin are added into the mould and the mould is closed tight. The polyolefin granules must be suitable for rotational moulding and may include polypropylene and polyethylene materials, for example. A particularly preferred polyolefin is polyethylene and preferred forms of polyethylene include those that can accommodate pigments and ultra violet radiation stabilizers (i.e. to provide a higher resistance to degradation under exposure to ultra violet radiation). One example of a polyethylene material that can be used is Qenos Alkathene 711 UV. Such polyethylene materials have a generally good chemical resistance to pollutants and can be more readily cleaned of graffiti than other materials, such as stone or concrete panel materials. Panel shells formed of such polyethylene materials may also have an anti-graffiti coating applied thereto, such as a coating provided by APP of Keysborough, Victoria, Australia. Such polyethylene materials are also readily cleanable, for example by a water jet, and do not stain or burn easily. Particular forms of polyethylene that may be suitable include linear low density polyethylene and medium density polyethylene. In some embodiments, high density polyethylene may also be used. In embodiments employing polyethylene or polypropylene as the material for the panel shell, the polyethylene or polypropylene material added into the mould preferably contains suitable additives for UV resistance and/or pigmentation and/or graffiti resistance.

Sound attenuation properties of panels according to described embodiments are designed to meet the requirements of the relevant Australian and/or international standards. For example, attenuation of sound through described panel embodiments may be at least about 25 decibels at frequencies between 250 Hz and 5000 Hz.

At step 2230, the panel 100 is formed using conventional rotational moulding techniques, including heating the mould while rotating it around two different axes of rotation so that the polyolefin granules melt and accrete on the inside surfaces of the mould plates. This heating and rotation is performed for a set period of time, following which the mould is cooled and then, at 2240, the formed panel is removed from the mould.

For formation of panels 1900, the panel shell formed at steps 2210 to 2240 may be cut at 2250 to separate front and back wall panels from each other and thus form the front and back wall panels 1904, 1902 as shown in FIG. 19. Although not shown in FIG. 19, a panel shell formed in the shape illustrated in FIGS. 1A, 1B and 1C may be used to form the panel 1900, preserving the shape and form of the recesses 117, 118 and 119 and retaining the general shape of end 111 on either the front wall 1904 or back wall 1902 once they are separated. When separating the front and back walls at 2250, the end face 105 of the panel shell may be cut off to allow insertion of a spacer 1930 to act as an end face, as shown in FIG. 19. Alternatively, instead of using spacers 1930 in each adjacent panel, a single coupling insert, for example in the form of a sleeve insert, can be used to couple the two adjacent ends of the panels 1900 together (e.g. by riveting or using other fastening means). Alternatively, the form and shape of the end face 105 may be retained on one of the separated front and back walls 1904, 1902 and employed for end-to-end cooperation in the manner described above in relation to panels 100.

As part of the cutting step 2250, the original walls along top and bottom edge faces 108, 106 that define the top and bottom recesses 109, 107 may be at least partially cut away, with the result that the longitudinally extending recesses 1907, 1909 are instead formed by an open channel defined in part by the recesses 1941 and 1942 of the spacers 1930 (or recesses 2441 and 2442 of spacer 2430) positioned at locations along the length of the panel 1900. In between the positions of the spacers 1930 or 2430, the top and bottom longitudinal recesses 1909, 1907 are effectively defined by an open gap between the front and back walls 1904, 1902.

At 2260, the spacers 1930 or 2430 (or a combination thereof) are inserted and connected in a vertical bridging orientation between the front and back panel walls 1904, 1902 using suitable connection means, such as rivets, to form the panel 1900 in the manner illustrated in FIGS. 19 and 20.

The method 2200 may be used to form panels of varying sizes, shapes and configurations, but for longer panels and particularly those panels over about three metres in length, each panel may have some form of reinforcing structure, for example in the form of metallic reinforcing elements or other non-metallic strengthening, stiffening or reinforcing structure.

While described embodiments are considered to be particularly suitable for sound attenuation barriers, some embodiments are directed more generally to wall panels that can be used in different ways. For example, described embodiments may be used as panels for cladding of buildings or to form an exterior face or design on a building, since they are light, easily transportable and can be readily customised. Further, rotational moulding of such panels can provide significant advantages over traditional concrete panel forming.

A further advantage of panel embodiments described herein is that they are formed of a recyclable plastic that can be readily separated from associated reinforcing of support structure for recycling, if desired.

Figure 23:
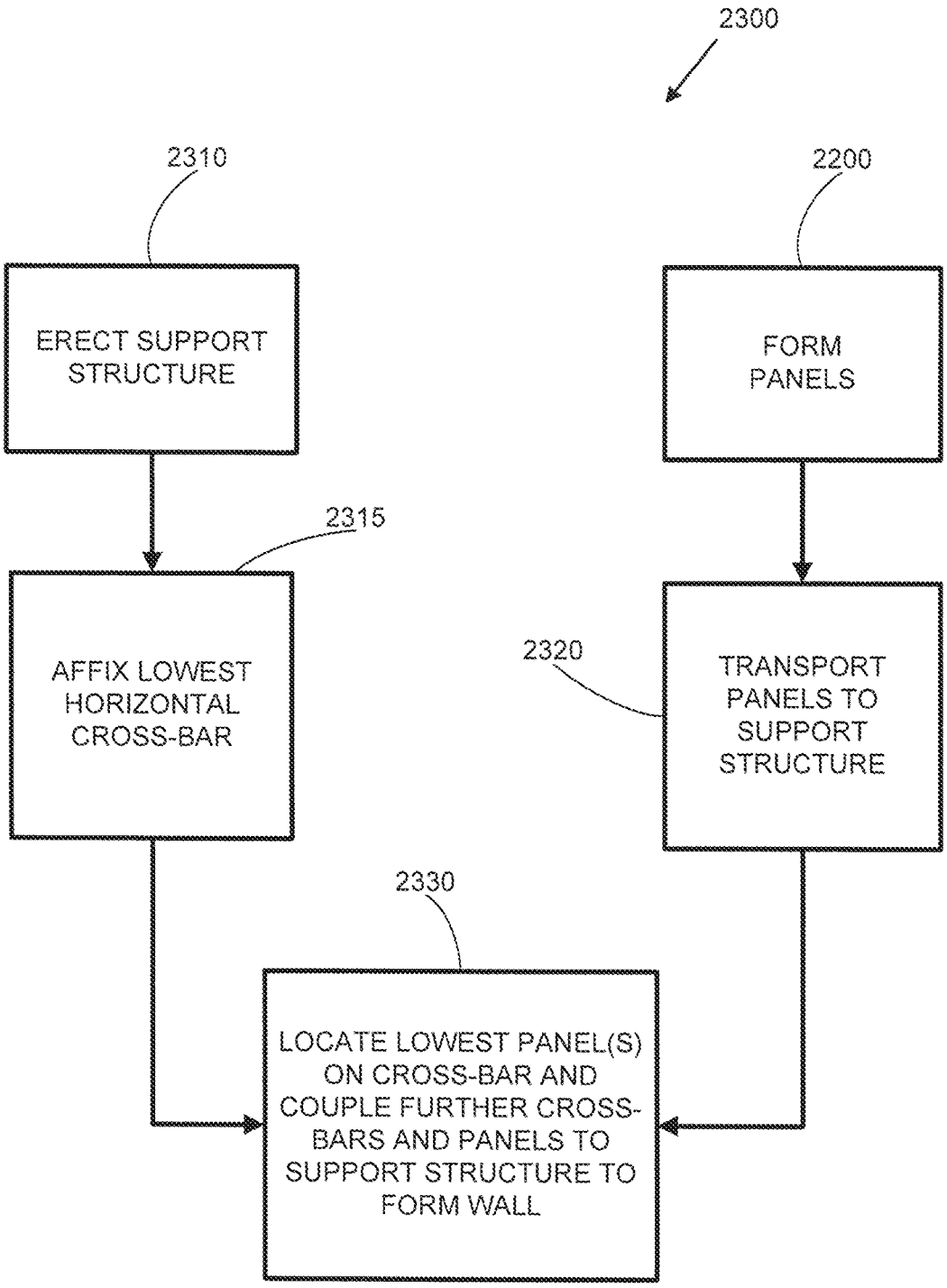
FIG. 23 is a flow chart of a method of forming a barrier or wall comprising panels according to some embodiments.

Referring also to FIG. 23, a method 2300 of forming a wall structure using described panel embodiments is described in further detail. Method 2300 involves the formation of panels according to method 2200. Contemporaneously with the panel formation, support structure may be erected on a chosen site at step 2310. A lowest cross-beam 420 is affixed at 2315 to the vertical support structures (i.e. two vertical beams 410) at a lowest point at which the panels 100 or 1900 are to be supported in relation to the frame 400. The vertical support structure may be formed before or after the panel formation, however. The panels, once formed, are transported to the site at step 232 here the support structure has been erected.

At step 2330, the panels are coupled to the support structure to form a wall. As described previously, such panels may be used to form a sound attenuation barrier 500 or 1500, with multiple wall sections 502, 1502. Alternatively, the wall may not be intended to function solely as a sound attenuation barrier and may form part of a building structure, such as cladding or an exterior pattern or surface of a building. The coupling of the panels at 2330 to the support structure may be as previously described, for example using coupling structure 430, 431.

Once the lowest crossbeam 420 is affixed at 2315, the panels 100 or 1900 can be positioned on the lowest cross bar and the next cross bar 421 can be positioned to be received within the recess 109 or 1909 to hold the lowest one or plural panels 100 or 1900 in place. Step 2230 thus involves sequentially locating panels on top of a cross bar and securing them in position by locating another cross bar in the longitudinal recesses across the top of the panel until the desired number of rows of panels have been put in place.

Reference is also made to FIGS. 26A, 26B, 26C and 26D, which illustrate a panel 2600, which is a modified version of panel 100. Embodiments of panel 2600 are substantially the same as embodiments of panel 100, except that panel 2600 has one or more bridging portions 2620 that form a material bridge between the front and back walls 104, 102. These bridging portions 2620 may be formed integrally with the front and back walls 104, 012 during the rotational moulding process described herein. The bridging portion 2620 thus may comprise a first inwardly projecting portion 2624 that is integrally formed with, and extends inwardly from, the outer surface of the front wall 104 and a second inwardly projecting portion 2622 that is integrally formed with, and extends inwardly from, the outer surface of the back wall 102. The inwardly projecting portions 2624 and 2622 define opposed cavities that are recessed inwardly from the front and back walls 104, 102 toward where the projecting portions meet. The first and second projecting portions 2624 and 2622 meet and bond with each other at a position toward the middle of the interior of the panel 2600. A plurality of the bridging portions 2620 may be disposed along the longitudinal length of the panel 2600 at spaced positions inward of the opposed panel ends 111, 112. The bridging portions 2620 serve to increase the structural strength of the front and back panel walls 104, 102 in the horizontal (front to back or back to front) direction. Although FIGS. 26A to 26D show front and back walls 104, 102 having a plain (but slightly convex) surface apart from the recesses defined by the bridging portions 2620, various other surface patterns or variations of the front and back walls 104, 102 can be moulded, if desired. Where there is a surface pattern or variation defined by the front and/or back walls 104, 102 bridging portions 2620 may be easily formed where the parts of the walls come close to each other due to the variations.

Embodiments have been described generally herein by way of non-limiting example. Thus, this detailed description should be taken as illustrative and not restrictive, taking into account that some variation or modification of the described embodiments is possible without departing from the spirit and scope of the invention or inventions described herein.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A barrier comprising:

at least one panel comprising a hollow rotationally molded plastic wall panel for forming part of a sound attenuation barrier, the hollow rotationally molded plastic wall panel having a length greater than a width, a thickness less than the width, a front wall, an opposite back wall and opposed first and second long edge regions, wherein the hollow rotationally molded plastic wall panel comprises a first end and a longitudinally opposite second end, wherein the first long edge region defines a first recessed portion to longitudinally receive and mate with a first longitudinal support structure and wherein the second long edge region defines a second recessed portion to longitudinally receive and mate with a second longitudinal support structure, wherein the first and second recessed portions of the hollow rotationally molded plastic wall panel are generally longitudinally extending; wherein the hollow rotationally molded plastic wall panel comprises a plurality of bridging portions to each form a material bridge between the front wall and the back wall, the plurality of bridging portions being integrally formed with the front wall and the back wall, and the plurality of bridging portions being disposed along the length at spaced positions inward of the first end and the second end;

a vertically extending support structure that is fixed relative to a ground; and the first and second longitudinal support structures coupled to the vertically extending support structure;

wherein the first and second longitudinal support structures are respectively received in the first recessed portion and the second recessed portion so that the hollow rotationally molded plastic wall panel is supported by the first and second support structures, wherein a first beam of the first and second longitudinal support structures is fixedly connected to the vertically extending support structure at a lowest beam position and at least a second beam of the first and second longitudinal support structures is fixedly connected to the vertically extending support structure at a position vertically spaced above the lowest beam position to secure the hollow rotationally molded plastic wall panel between the first beam and the second beam.

2. The barrier of claim 1, wherein each of the plurality of bridging portions comprises a first inwardly projecting portion that extends inwardly from the front wall and a second inwardly projecting portion that extends inwardly from the back wall.

3. The barrier of claim 2, wherein first and second projecting portions of each of the bridging portions meet and bond with each other at a position toward a middle of an interior of the panel.

4. The barrier of claim 1, wherein the length of the panel is between about 2 m and about 4 m.

5. The barrier of claim 1, wherein the thickness of the panel is between about 15 cm and about 25 cm.

6. The barrier of claim 1, wherein the width of the panel is between about 30 cm and about 100 cm.

7. The barrier of claim 1, wherein the first and second recessed portions are defined by the hollow rotationally molded plastic wall panel to have a depth and a width, wherein the depth is about half of the width of the first and second recessed portions.

8. The barrier of claim 1, wherein the hollow rotationally molded plastic wall panel is free of non-moulded longitudinal reinforcing structure.

9. The barrier of claim 1, wherein the hollow rotationally molded plastic wall panel defines at least one locating recess to allow positioning of the panel in one or more specific positions in relation to cooperating structure on the first or second support structures.

10. The barrier of claim 1, wherein the hollow rotationally molded plastic wall panel is configured to accommodate movement due to thermal expansion or contraction in a direction of the length or a direction of the width relative to the first and second support structures.

11. The barrier of claim 1, wherein attenuation of sound through the hollow rotationally molded plastic wall panel is at least about 25 decibels at frequencies between 250 Hz and 5000 Hz.

12. The barrier of claim 1, wherein the barrier comprises two of the hollow rotationally molded plastic wall panels supported by the first and second longitudinal support structure.

13. The barrier of claim 1, for use in a sound attenuation barrier near a roadway.

14. The barrier of claim 1, wherein the first and second recessed portions have substantially the same shape.

15. The barrier of claim 1, wherein two panels of the at least one panel are positioned end-to end in a line between the first beam and the second beam.

16. The barrier of claim 1, wherein the first longitudinal support structure is in the form of a first crossbeam and wherein the second longitudinal support structure is in the form of a second crossbeam.

17. The barrier of claim 1, wherein the first and second recessed portions of the hollow rotationally molded plastic wall panel are approximately u-shaped in cross-section.

18. The barrier of claim 1, wherein the second beam is clamped to the vertically extending support structure.

19. A method of erecting a barrier, comprising:

erecting a vertically extending support structure that is fixed relative to a ground;

coupling at least two vertically spaced, horizontally extending support beams to the vertically extending support structure; and positioning at least one panel to be supported in between two of the at least two horizontally extending support beams, the at least one panel comprising a hollow rotationally molded plastic wall panel, the hollow rotationally molded plastic wall panel having a length greater than a width, a thickness less than the width, a front wall, an opposite back wall and opposed first and second long edge regions, wherein the hollow rotationally molded plastic wall panel comprises a first end and a longitudinally opposite second end, wherein the first long edge region defines a first recessed portion to longitudinally receive and mate with a first one of the horizontally extending support beams and wherein the second long edge region defines a second recessed portion to longitudinally receive and mate with a second one of the horizontally extending support beams, wherein the first and second recessed portions of the hollow rotationally molded plastic wall panel are generally longitudinally extending; wherein the hollow rotationally molded plastic wall panel comprises a plurality of bridging portions to each form a material bridge between the front wall and the back wall, the plurality of bridging portions being integrally formed with the front wall and the back wall, and the plurality of bridging portions being disposed along the length at spaced positions inward of the first end and the second end;

wherein the coupling comprises fixedly connecting the first one of the horizontally extending support beams to the vertically extending support structure at a lowest beam position and fixedly connecting the second one of the horizontally extending support beams at a position vertically spaced above the lowest beam position to secure the at least one panel between the first horizontally extending support beam and the second horizontally extending support beam.

20. The method of claim 19, wherein the coupling and positioning are performed in sequence so that a lower support beam is coupled to the vertically extending support structure, then at least one panel is positioned to rest on the lower support beam, then an upper support beam is coupled to the vertically extending support structure to hold the at least one panel in between the lower support beam and the upper support beam.

21. The method of claim 20, wherein the positioning comprises positioning two panels of the at least one panel end-to-end in a line between two of the horizontally extending support beams.

22. The method of claim 19, wherein the first and second recessed portions of the hollow rotationally molded plastic wall panel are approximately u-shaped in cross-section.

* * * * *